US007346455B2

(12) United States Patent
Ward et al.

(10) Patent No.: US 7,346,455 B2
(45) **Date of Patent: *Mar. 18, 2008**

(54) WELLBORE EVALUATION SYSTEM AND METHOD

(75) Inventors: Simon J. Ward, Spring, TX (US); John P. Rogers, Houston, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 57 days.

This patent is subject to a terminal disclaimer.

(21) Appl. No.: 11/430,363

(22) Filed: May 9, 2006

(65) Prior Publication Data

US 2006/0271299 A1 Nov. 30, 2006

(51) Int. Cl.
*G01V 1/40* (2006.01)
*E21B 25/16* (2006.01)

(52) U.S. Cl. ..... 702/6; 175/45

(58) Field of Classification Search ..... 702/6, 702/33, 34, 81, 84; 705/22, 28; 175/45–46, 175/61; 166/255.2; 73/152.44; 367/33
See application file for complete search history.

(56) References Cited

U.S. PATENT DOCUMENTS

| | | | | |
|---|---|---|---|---|
| 2,555,853 A | | 6/1951 | Irwin | 324/242 |
| 2,855,564 A | | 10/1958 | Irwin et al. | 324/242 |
| 3,753,296 A | | 8/1973 | Van Steenwyk | 33/304 |
| 3,958,049 A | | 5/1976 | Payne | 427/327 |
| 4,302,866 A | | 12/1981 | Irvin | 16/257 |
| 4,468,863 A | | 9/1984 | Van Steenwyk | 33/304 |
| 4,492,115 A | | 1/1985 | Kahil et al. | 73/152.01 |
| 4,636,727 A | | 1/1987 | Kahil et al. | 324/227 |
| 4,715,442 A | | 12/1987 | Kahil et al. | 166/250.01 |
| 4,843,317 A | | 6/1989 | Dew | 324/221 |
| 4,987,684 A | | 1/1991 | Andreas et al. | 33/304 |
| 5,115,863 A | | 5/1992 | Olinger | 166/241.1 |
| 5,339,896 A | | 8/1994 | Hart et al. | 166/241.1 |
| 5,487,426 A | | 1/1996 | O'Hair | 166/378 |
| 5,492,174 A | | 2/1996 | O'Hair | 166/241.4 |
| 5,511,619 A | | 4/1996 | Jackson | 166/369 |
| 5,821,414 A | * | 10/1998 | Noy et al. | 73/152.54 |
| 5,914,596 A | | 6/1999 | Weinbaum | 324/228 |
| RE36,362 E | | 11/1999 | Jackson | 166/369 |
| 6,109,370 A | * | 8/2000 | Gray | 175/61 |
| 6,152,223 A | | 11/2000 | Abdo et al. | 166/241.4 |

(Continued)

FOREIGN PATENT DOCUMENTS

WO WO 03/021248 A1 3/2003

*Primary Examiner*—John Barlow
*Assistant Examiner*—Toan M. Le
(74) *Attorney, Agent, or Firm*—Browning Bushman P.C.

(57) ABSTRACT

A wellbore evaluation system evaluates mechanical wear and corrosion to components of a well system including a production tubing string positionable in a well and a sucker rod string movable within the production tubing string. A deviation sensor determines a deviation profile of the production tubing string in the well, and a rod sensor senses and measures wear and corrosion to the sucker rod string as it is removed from the well to determine a rod profile. A data acquisition computer is in communication with the sensors for computing and comparing the deviation profile and the rod profile as a function of depth in the well. A 3-dimensional image of wellbores, with isogram mapping, may be generated and examined over the internet.

41 Claims, 17 Drawing Sheets

U.S. PATENT DOCUMENTS 6,308,787 B1 10/2001 Alft ..... 175/48
6,315,062 B1 * 11/2001 Alft et al. ..... 175/45
6,316,937 B1 11/2001 Edens ..... 324/220
6,349,779 B1 2/2002 Gilbert ..... 175/323
6,386,292 B1 5/2002 Bland ..... 166/387
6,405,808 B1 6/2002 Edwards et al. ..... 175/45
6,453,239 B1 9/2002 Shirasaka et al. ..... 701/220
6,580,268 B2 6/2003 Wolodko ..... 324/240
6,668,465 B2 * 12/2003 Noureldin et al. ..... 33/304
6,704,656 B1 3/2004 Abriol et al. ..... 702/6
6,714,870 B1 3/2004 Weston et al. ..... 702/9
6,749,031 B2 * 6/2004 Klemm ..... 175/73
6,871,410 B1 * 3/2005 Le Jeune ..... 33/313
7,093,370 B2 * 8/2006 Hansberry et al. ..... 33/313
7,107,154 B2 * 9/2006 Ward ..... 702/6

* cited by examiner

WELLBORE EVALUATION SYSTEM AND METHOD

FIELD OF THE INVENTION

The present invention relates to equipment and techniques to evaluate wellbore conditions. More particularly, the invention relates to improved techniques to evaluate wear and corrosion of one or more strings in a production wellbore having a downhole pump driven by a sucker rod powered at the surface.

BACKGROUND OF THE INVENTION

Oil and gas wells are typically drilled with a rotary drill bit, and the resulting borehole is cased with steel casing cemented in the borehole to support pressure from the surrounding formation. Hydrocarbons may then be produced through smaller diameter production tubing suspended within the casing. Although fluids can be produced from the well using internal pressure within a producing zone, pumping systems are commonly used to lift fluid from the producing zone in the well to the surface of the earth. This is often the case with mature producing fields where production has declined and operating margins are thin.

The most common pumping system used in the oil industry is the sucker rod pumping system. A pump is positioned downhole, and a drive motor transmits power to the pump from the surface with a sucker rod string positioned within the production tubing. Rod strings include both "reciprocating" types, which are axially stroked, and "rotating" types, which rotate to power progressing cavity type pumps. The latter type is increasingly used, particularly in wells producing heavy, sand-laden oil or producing fluids with high water/oil ratios. The rod string can consist of a group of connected, essentially rigid, steel or fiberglass sucker rod sections or "joints" in lengths of 25 or 30 feet. Joints are sequentially connected or disconnected as the string is inserted or removed from the borehole, respectively. Alternatively a continuous sucker rod (COROD) string can be used to connect the drive mechanism to the pump positioned within the borehole.

A number of factors conspire to wear down and eventually cause failure in both sucker rods and the production tubing in which they move. Produced fluid is often corrosive, attacking the sucker rod surface and causing pitting that may lead to loss of cross-sectional area or fatigue cracking and subsequent rod failure. Produced fluid can also act like an abrasive slurry that can lead to mechanical failure of the rod and tubing. The rod and tubing also wear against each other. Such wear may be exacerbated where the well or borehole is deviated from true vertical. Even boreholes believed to have been drilled so as to be truly vertical and considered to be nominally straight may deviate considerably from true vertical, due to factors such as drill bit rotational speed, weight on the drill bit, inherent imperfections in the size, shape, and assembly of drill string components and naturally-occurring changes in the formation of the earth that affect drilling penetration rate and direction. Also, some boreholes are intentionally drilled at varying angles using directional drilling techniques designed to reach different parts of a hydrocarbon-producing formation. As a result, sucker rods and production tubing are never truly concentric, especially during the dynamics of pumping, and instead contact one another and wear unpredictably over several thousand feet of depth. Induced wear is therefore a function of many variables, including well deviation from true vertical; angle or "dogleg" severity; downhole pump operating parameters; dynamic compression, tensile and sidewall loads; harmonics within the producing sucker rod string; produced solids; produced fluid lubricity; and water to oil ratio. Additionally, in certain conditions, such as in geologically active areas or in areas of hydrocarbon production from diatomite formations, wellbores may shift over time, causing additional deviation from vertical.

Boreholes deviate considerably from true vertical due to various factors, including drill bit rotational speed, weight on the drill bit, inherent imperfections in the size, shape, and assembly of drill string components and naturally-occurring changes in the formation of the earth. When using a tubing anchor to rigidly fix the lower part of a tubing string in a wellbore relative to the casing, it is often necessary to apply a tensile load to the tubing string to prevent sags or kinks in the tubing in certain zones of the wellbore. In certain conditions, such as in geologically active areas or in areas of hydrocarbon production from diatomite formations, producing wells may shift over time, causing additional deviation from vertical. As a result, sucker rods and production tubing are often never truly concentric, especially during the dynamics of pumping, and instead contact one another and wear in certain areas, some of which are known as "doglegs", or where the tubing sags or is kinked. Without a continuous deviation survey of the wellbore, it is difficult, if not impossible, to identify areas where the well deviation from vertical results in contact and wear of the rods and tubing.

For many years it has been possible to determine the deviation of a borehole, or wellbore, from true vertical. Such techniques are used extensively in the drilling of new wellbores, either as periodic "single shot" surveys, "multi-shot" surveys or even continuously while drilling, known as "MWD". U.S. Pat. No. 6,453,239 to Shirasaka, et al, U.S. Pat. No. 5,821,414 to Noy, et al, U.S. Pat. No. 4,987,684 to Andreas, et al and U.S. Pat. No. 3,753,296 to Van Steenwyk, disclose such examples of surveying wellbores. However, in the case of most existing rod-pumped oil wells, any such surveys performed during the original drilling of the well largely comprised periodic surveys of wellbore direction and inclination performed only at one or two key intervals during the well-drilling operation. Consequently, a continuous profile of the wellbore deviation, giving rise to tubing and rod wear, is not generally known. Alternatively, performing a dedicated, continuous directional survey of existing wellbores, such as those contemplated in the above patents, is generally cost-prohibitive. There is a need for a cost-effective directional survey that can be integrated into well work-over operations of existing producing wellbores to obtain an accurate, nearly continuous deviation profile and allow mitigation of rod and tubing wear.

Prior art wellbore deviation techniques and tools are generally designed for the measurement of a wellbore while drilling, or are used on wireline or slickline during the process of drilling, to measure the direction and inclination of the wellbore with respect to an as-yet un-reached planned trajectory or target of interest. Prior art accelerometer and magnetometer deviation tools are also typically capable of determining wellbore inclination and azimuth only outside of the presence of magnetic interference, e.g., in open, uncased wellbores.

Oil well production string inspection methods conventionally use magnetic flux leakage techniques and typically rely only upon signal amplitude and time-based denominations or, in some cases, signal amplitude and wellbore depth, to provide the equipment operator with information representing the sucker rod or tubing string condition. U.S. Pat. Nos. 2,555,853, 2,855,564, 4,492,115, 4,636,727, 4,715,442, 4,843,317, 5,914,596, 6,316,937 disclose methods and apparatus to perform magnetic flux leakage inspections of sucker rods and tubing as elements of the production wellbore.

The amplitude of a magnetic flux leakage signal from a flaw in a ferromagnetic material under test is a function of many variables, including magnetic permeability of the material under test; magnetizing field strength; detection sensor type; sensor-to-material-under-inspection stand-off; flaw orientation relative to magnetic field direction; flaw volume; flaw depth, flaw shape; sensor-to-material-under-inspection relative velocity; sensor signal filtering and; sensor signal-to-noise ratio, among others. Conventional systems that rely only upon amplitude and time, or upon amplitude and wellbore depth, are susceptible to misinterpretation since the apparent flaw signal amplitude may be a function of many factors other than depth alone. Many such systems do not employ field standardization techniques to establish flaw standardization levels for inspection. Even those methods that do employ standardization techniques rely upon signal amplitude alone for flaw severity analysis.

Some prior art gyroscope and accelerometer deviation tools, of either the gimballed or strapped-down type, are capable of use inside cased hole and are generally used during the drilling process. U.S. Pat. No. 4,468,863 discloses a single shot or periodic multi-shot survey tool deployed on a wireline. U.S. Pat. No. 5,821,414 discloses a system for measuring deviation and inclination, while a wellbore is being drilled, to achieve an ultimate bottom hole location that positions the wellbore to optimally drain the target hydrocarbon reservoir. Most Measurement-While-Drilling applications that are intended for open hole, high temperature, high pressure environments, as disclosed in U.S. Pat. No. 6,714,870 to Weston, et al. Such tools are typically large, insulated, shock-absorbing, high pressure- and temperature-resistant to handle the extremely demanding environment of drilling in extreme temperature, vibration and pressure, as disclosed in U.S. Pat. No. 4,302,886. Systems may utilize relatively gimbaled gyroscopes or expensive and complex Coriolis-effect strapped-down gyroscopes, as disclosed in U.S. Pat. No. 6,453,239. Such tools are generally too large and lengthy to be used inside small diameter production tubing, and too expensive for most pumped well application. The high cost of these systems prohibits consideration by the operators of relatively shallow, existing rod-pumped, producing wells in the declining fields of mature sedimentary basins.

Failure of pumped oil wells due to the cumulative effect of the wear of sucker rods on tubing and such wear combined with corrosion is considered to be the single largest cause of well down time. Generally accepted methods of mitigating such wear include installing rod guides to centralize the sucker rod in the tubing with selected tubing surface contact materials; sinker bars to add weight to the sucker rod string; tubing insert liners composed of wear-resistant materials such as nylon and polythene; and improving operational practice. Examples of rod guides are disclosed in U.S. Pat. No. 6,152,223 to Abdo, U.S. Pat. No. 5,339,896 to Hart, U.S. Pat. No. 5,115,863 to Olinger, and U.S. Pat. Nos. 5,492,174 and 5,487,426 to O'Hair. An example of a tubing liner insert is U.S. Pat. No. 5,511,619 to Jackson. Since many of these mitigation techniques are expensive to apply, oil well operators must carefully assess the economics of any such mitigation techniques.

Although wear can be mitigated, it cannot be eliminated, so inspection of sucker rods and production tubing are common in the industry. Well operators within the industry commonly follow a "run until failure" approach, only inspecting components upon failure of some element of the wellbore, which may include a hole or split in the tubing, pump failure, rod failure, or tubing separation. The nature of the industry is that down-time is costly, both in terms of lost or deferred production and the actual cost to repair the failure by work-over of the wellbore. Another reason well operators are reluctant to perform inspections at regular intervals is that the diagnostic capabilities of current inspection practices are somewhat limited. A more useful, reliable, and economical method of wear and corrosion pattern analysis and diagnosis that gives rise to mitigation opportunities would allow operators to be more proactive. Further, many operators are unable to devote the time and human resources to perform the necessary analysis of data such as well deviation, rod failure and tubing failure.

The most basic wear analysis techniques include simply observing the wear patterns contained within the individual lengths of oil well production tubing, to empirically inspect tubing for wall thickness loss due to mechanical wear and corrosion of sucker rods and tubing. Caliper surveys are available to measure the inside diameter of production tubing but cannot examine the condition of the outside condition of the tubing.

More sophisticated inspection techniques employ magnetic sensor technologies to assess the condition of production tubing. Magnetic testing devices have been known for many years, as disclosed in U.S. Pat. No. 2,555,853 to Irwin and more specifically for oilfield tubulars and sucker rods in U.S. Pat. No. 2,855,564 to Irwin for a Magnetic Testing Apparatus and Method. Applying this technology to the inspection of oilfield tubulars, U.S. Pat. Nos. 4,492,115, 4,636,727 and 4,715,442 disclose tubing trip tools and methods for determining the extent of defects in continuous production tubing strings during removal from the well. The tools and methods include magnetic flux leakage sensor coils and Hall effect devices for detecting defects such as average wall thickness, corrosion, pitting, and wear. One or more of the above tools further include a velocity and position detector for correlating the location of individual defects to their locations along the tubing string. A profile of the position of the defects in the continuous string can also be established.

U.S. Pat. No. 4,843,317 to Dew discloses a method and apparatus for measuring casing wall thickness using an axial main coil for generating a flux field enveloping the casing wall. U.S. Pat. No. 6,316,937 to Edens discloses a combination of magnetic Hall effect sensors and digital signal processing to evaluate defects and wear. U.S. Pat. No. 5,914,596 to Weinbaum discloses a magnetic flux leakage and sensor system to inspect for defects and measure the wall thickness and diameter of continuous coiled tubing. All of these systems induce magnetic flux within the tubing. Surface defects result in magnetic flux leakage. Sensors measure the leakage and are thereby used to locate and quantify the surface defect.

Techniques are also known for magnetically inspecting sucker rods. Conventional sucker rod segments are commonly removed from an oil well, separated, and trucked to inspection plants to be "reclaimed". U.S. Pat. No. 2,855,564 to Irwin discloses a magnetic testing apparatus used in inspection of sucker rods, and U.S. Pat. No. 3,958,049 to Payne discloses an example of a process for reclaiming used sucker rod. In the latter patent, the salvaged rod is degreased, visually inspected, subjected to a shot peening operation, and analyzed for structural imperfections. Magnetic induction techniques are employed, albeit at an inspection plant, rather than on-site. A system for evaluating a coiled sucker rod string, or "COROD", as it is pulled from a well is disclosed in U.S. Pat. No. 6,580,268. Defects within the COROD may be correlated with their position. The system generates "real time" calculated dimensional display of the COROD and cross-sectional area as a function of position. Wireless technology can be used, such as to convey signals from a processor unit as many as 200 feet to a laptop server.

Aspects of the sucker rod and production tubing inspection techniques discussed above have a certain level of sophistication, such as the use of wireless technology and digital signal processing. Ironically, however, the analyses derived from the resulting data are relatively limited and shortsighted. The data obtained is not optimally used to correct or mitigate wear. For example, the end result of conventional sucker rod inspection and reclamation is the rather simplistic determination of whether to re-classify and reuse or dispose of each rod.

Additionally, because the production tubing in most rod-pumped producing wells is tubing that has previously been used in other wells or from such reclaimed supplies, pre-existing wear patterns on tubing alone are often misleading as to the root causes of tubing wear in the current wellbore. Further, even a detailed, positional analysis of defects does not provide an adequate window as to their root cause or mitigation. For example, in general, well operators simply reposition rod guides, which may merely shift wear on the rod or tubing to another position along the string. An alternative technique to mitigate rod wear on tubing is disclosed in U.S. Pat. No. 36,362E to Jackson, whereby an abrasion resistant polymer, such as polyethylene, is inserted into the tubing. This technique, however, reduces the inside diameter of the tubing and does not assess the cause of tubing wear. As a result, the polythene liner may simply fail over time, rather than the tubing, which still necessitates work-over. Not even "real time" data reports provide an adequate solution to mitigating wear, because they do nothing to improve the quality or scope of the analysis, or correlate tubing condition information with rod condition information. An accurate analysis of the cause of wellbore failure due to tubing or rod failure is also aided with a profile of the wellbore deviation.

Another problem with existing inspection systems is that there is no available means of performing these assessments in a cost-effective and timely manner so that tubing wear can be mitigated through an economical solution specific to a well. Because quickly returning the well to production is of paramount importance, full analysis of any limited information available is often difficult, if not impossible, to perform before the well is returned to production.

The disadvantages of the prior art are overcome by the present invention. An improved system is provided for evaluating and mitigating one or more of wear and corrosion on rod strings and/or tubular strings while being pulled from a wellbore.

SUMMARY OF THE INVENTION

A wellbore evaluation system and method are provided for evaluating one or more of wear and corrosion to certain critical components of a well system. The well system includes a production tubing string positionable in a well and a sucker rod string movable within the production tubing string. In one embodiment, two or more sensors are selected from the group consisting of a deviation sensor movable within the well to determine a deviation profile; a rod sensor for sensing and measuring wear, corrosion pitting, cross-sectional area and diameter of the sucker rod string as it is removed from the well to determine a rod profile; and a tubing sensor for sensing and measuring wear, cross-sectional area, corrosion pitting, and/or holes or splits in the production tubing string as it is removed from the well to determine a tubing profile. A computer system, which may broadly include a central server-computer, a data acquisition computer system, and circuitry connected to the individual two or more sensors, is in communication with the two or more sensors for computing and comparing two or more of the respective deviation profile, rod profile, and tubing profile as a function of depth in the well. The computer preferably compares all three of the deviation profile, rod profile, and tubing profile.

In one embodiment, the computer outputs a wear mitigation solution, which may include installing or repositioning rod guides with respect to specific depth zones of the sucker rod string, lining the production tubing string with a polymer lining at specific depths, employing a tubing rotator to rotate the production tubing string, employing a sucker rod rotator to rotate the sucker rod string, changing pump size, stroke or speed, changing the diameter of a section of the sucker rod string, or replacing one or more segments of the production tubing string or sucker rod string.

The computer may output a visual representation of the comparison of two or more of the deviation profile, rod profile, and tubing profile. The visual representation may include a graphical display of two or more of the deviation profile, rod profile, and tubing profile. The visual representation may also include a three dimensional plot of the deviation profile, accompanied by other rod wear and tubing wear data.

In some embodiments, the computer compares two or more of the deviation profile, rod profile, and tubing profile with two or more previously performed profiles. The computer may also compare one or more of the deviation profile, rod profile, and tubing profile from the well system with profiles from another well, such as in a field of wells.

In one embodiment, a marking method is included for marking segments of one or both of the production tubing string and the sucker rod string when pulled from the well. A tracking device is responsive to the markings on the segments as they are inserted into the well, and a computer is in communication with the tracking device for tracking the relative position of each of the segments of the respective production tubing string and sucker rod string. Typically, the markings will comprise bar code markings, and the tracking device will comprise a bar code reader for reading the bar code markings.

The deviation sensor preferably comprises three pairs of gyroscopes and three pairs of accelerometers, with each pair positioned orthogonally with respect to the two other pairs. The rod sensor preferably comprises one or more of a magnetic flux sensor, Hall effect sensor, an LVDT, a laser micrometer and a laser triangulation sensor. The tubing sensor comprises one or more of a magnetic flux sensor and a Hall effect sensor.

Some embodiments include a plurality of differently sized sensor inserts for accommodating a plurality of diameters of the sucker rod string and production tubing. Each sensor insert may include a plurality of rod sensors and a plurality of tubing sensors. A sensor barrel selectively receives each of the differently sized sensor inserts.

The rod sensor typically senses and measures a coupling that joins segments of the sucker rod string, diameter of the coupling, and then measures one or more of wear to a rod guide, rod diameter, rod cross-sectional area, and pitting. The tubing sensor typically senses and measures one or more of tubing wear cross-sectional area, wall thickness, and pitting. The deviation sensor typically senses and measures one or more of wellbore dogleg severity, inclination angle, change in inclination angle and azimuth.

In some embodiments, the wear evaluation system is tailored to specifically evaluate one or more of wear and corrosion to a string as it is pulled from the well, whether that be a rod string or a production tubing string. Segmented rod strings include multiple segments coupled with larger diameter couplings. The magnetic sensing devices and/or laser micrometer and/or laser triangulation sensors may be radially spaced from the rod string, such that they do not interfere with the larger diameter couplings.

The foregoing is intended to give a general idea of the invention, and is not intended to fully define nor limit the invention. The invention will be more fully understood and better appreciated by reference to the following description and drawings.

DETAILED DESCRIPTION OF THE PREFERRED EMBODIMENTS

Figure 1:
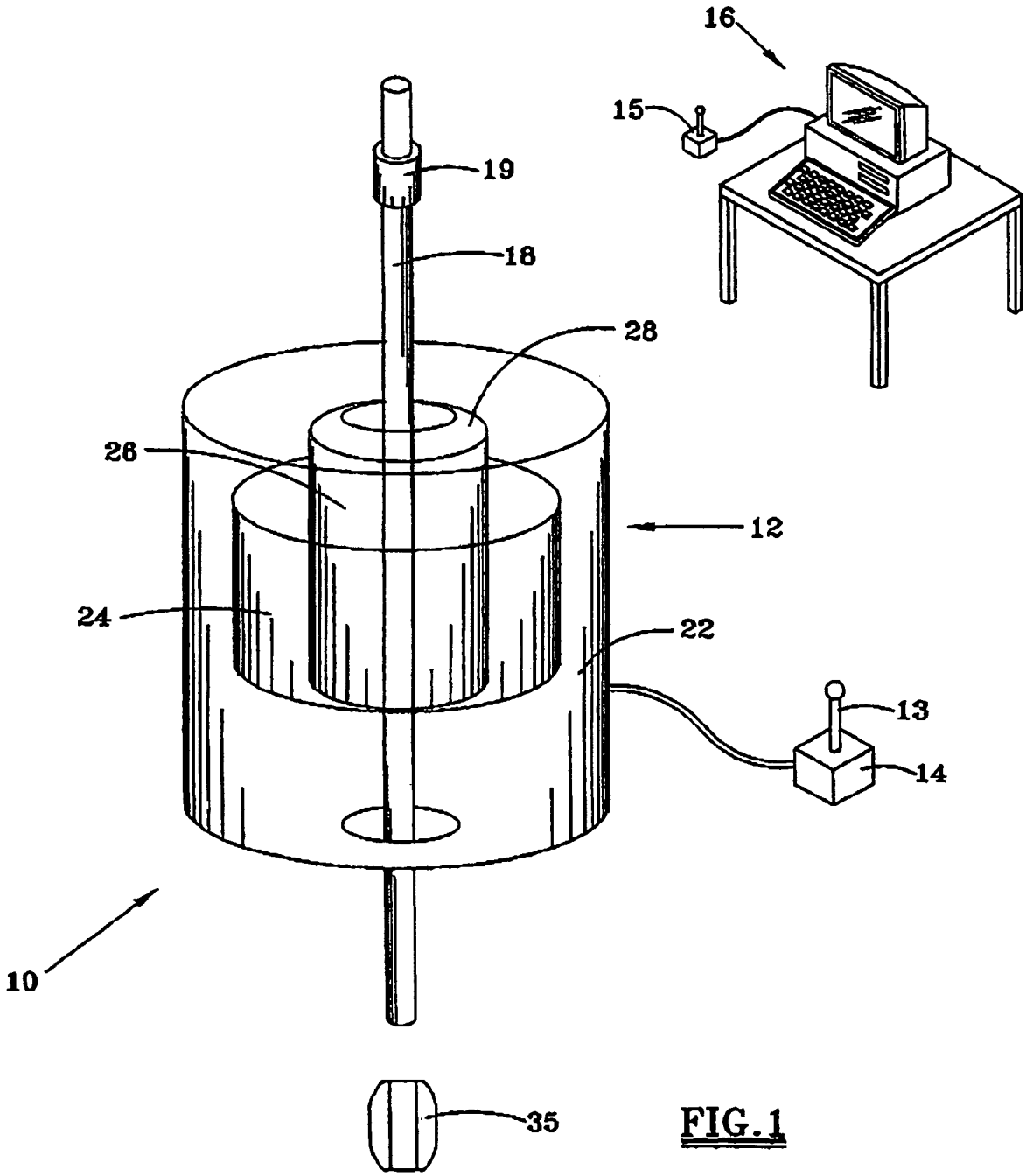
FIG. 1 conceptually illustrates a preferred embodiment of the wear evaluation system including a removable sensor insert for sensing a segmented, coupled sucker rod string being pulled from the well.

A preferred embodiment of a wear evaluation system is indicated generally at 10 in FIG. 1. An embodiment of sensor package 12 including a rod sensor and tubing sensor is detailed further in FIG. 2. The sensor package 12 may be positioned on a rig floor. A deviation sensor 28 is detailed further in FIG. 3, as it is dropped to the bottom of well 7 in the production tubing string 20 by gravity or lowered on wireline 32 through tubing string 20. The system 10 evaluates wear, corrosion pitting, cross-sectional area and certain diameters of components of a well system that includes a segmented production tubing string 20 positionable in well 7 and a segmented sucker rod string 18 movable within the production tubing string 20. Segmented sucker rod string 18 has multiple segments coupled together with larger diameter couplings 19, although a sucker rod string may alternatively be a continuous rod or "COROD." Sucker rod strings may include both reciprocating type rods, which reciprocate axially in a well, or rotating type rods, which rotate to power a progressive cavity pump. System 10 may be a portable and/or truck-mounted field unit. Sensor package 12 and deviation sensor 28 both communicate with data acquisition computer system 14, and thereby with server computer system 16 to compute and compare information such as (i) the wellbore deviation; (ii) the condition of the tubing 20 in terms of holes, splits, corrosion pitting, rod wear, cross sectional area and other wall-thickness reducing flaws; (iii) the condition of the sucker rod 18 in terms of pitting, wear, cross-sectional area and diameter; (iv) the condition of the couplings 19 in terms of diameter and wear; and (v) the condition of rod guide 35 in terms of diameter and wear. These criteria are computed as a function of depth within the wellbore in the form of profiles, such as a deviation profile, a rod profile, and a tubing profile, and the existence and severity of the criteria are correlated by comparing the profiles.

Correlation of these criteria is vastly more useful than merely determining the individual profiles. For example, analysis of wear detected on the inside surface of tubing 20 alone, without depth-correlated wear to rod 18 or rod coupling 19, at a depth where the deviation profile shows the wellbore to be vertical and straight may indicate that the observed tubing wear is unrelated to this particular wellbore. Alternatively, detection of rod wear on the tubing consistent with and related to sucker rod couplings diameter loss at the same depth, over several hundred feet, in an area where there is a measured material inclination from vertical, would indicate that rod guides would very effectively mitigate tubing wear and thereby extend well production time. Such a correlation analysis is essential for the accurate identification of the root cause of the condition and may only be performed with sufficient data.

A variety of sensor types are available for use with the sensor package 12. In FIG. 1, sensor package 12 includes an outer barrel 22, which acts as an enclosure for internal assemblies such as magnetic coil 24 fixed to the outer barrel 22. A sensor insert 26 is removably inserted into barrel 22. Sensor insert 26 typically includes one or more of magnetic flux leakage sensor coils or Hall effect sensors, linear variable differential transformers (LVDT), laser micrometers, and laser triangulation sensors. The sensor insert 26 may be positioned centrally about either the sucker rod 18 or production tubing 20, and may be selected from a group of differently sized inserts for accommodating a variety of rod or tubing diameters. Thus, the sensor package 12 may house both the rod sensor and the tubing sensor.

The rod sensor may obtain data such as wear to the coupling 19 that joins segments of the sucker rod string 18, minimum measured diameter of the coupling 19, wear to a rod guide 35, rod diameter, rod cross-sectional area, and rod pitting. Likewise, the tubing sensor may obtain data such as tubing wear, wall thickness, tubing diameter, cross-sectional area and pitting. The deviation sensor 28 may obtain data such as wellbore dogleg severity, inclination angle, change in inclination angle along the well, azimuth, and change of azimuth.

The rod profile is typically obtained first, the deviation profile second, and the tubing profile third. In a preferred embodiment, the deviation profile is obtained simultaneously with the tubing profile as the tubing is pulled from the well. First, the sucker rod 18 under inspection is pulled from the well by a work-over rig (not shown). As the rig pulls the rod 18, the characteristics of the rod 18 are sensed and measured to determine the rod profile. Data acquisition computer system 14 receives signals from the sensor package 12 and transmits them to the server computer 16. Data acquisition computer system 14 may compute the profiles prior to transmitting to server computer 16, where after the server computer 16 may act as a server. The transmittal between data acquisition computer system 14 and server computer 16 may be by wire, or alternatively by one of a variety of wireless communication technologies known in the art, as conceptually represented by antennas 13 and 15.

Second, after the sucker rod string 18 has been removed from the well 7, a gyroscope & accelerometer-based deviation sensor tool 28 is dropped to the bottom of the well 7 inside the tubing 20. Alternatively, the deviation sensor 28 may be lowered to the bottom of the well 7 on wireline 32. The deviation tool 28 measures and records the output from the accelerometers and gyroscopes in order to calculate inclination, rate of change of inclination and azimuth of the wellbore as the tool 28 is retrieved in the tubing by the work-over rig, or retrieved independently by wireline 32. The tool memory is downloaded into the data acquisition computer system 14 to compute and further process the deviation profile, comparing it with the rod profile and/or tubing profile. This information is also transmitted to server computer 16 for further processing as to the optimum wellbore wear mitigation solution.

Third, the production tubing string 20 is pulled from the well by the work-over rig and inspected similarly to the sucker rod string 18. As the rig pulls the tubing 20, the characteristics of the tubing 20 are sensed to determine the tubing profile. As with the rod string 18, the data acquisition computer system 14 receives signals from the sensor package 12, computes the tubing profile and transmits the information to the server computer 16. At least a portion of this computation may again be carried out by the data acquisition computer system 14.

Having acquired, processed, displayed, recorded and compiled the data, the server computer 16 may then act as a server. This server-computer 16 stores all the raw data, then applies the received information with a software program to calculate a mathematical model of wear to the well system. The model applies correlative techniques and other algorithms to determine a comprehensive wellbore condition profile. The server-computer 16 may then determine an optimal solution for the mitigation of wear within the well 7. The solution may be stored in the computer, acting as a central server, and then optionally transmitted back to the field unit, such as to data acquisition computer system 14, and made available for access over the internet to the appropriate personnel. The server computer 16 may thus be located several hundred feet, or several thousand miles away, enabled by internet and wireless technologies, such as satellite internet access. This is especially useful for management of a field of multiple wells. The server-computer 16 may store wear data for a multitude of wells, providing the convenience of one central processing location, and the ability to correlate not only the rod, tubing, and deviation data from one well, but to correlate like data from the multitude of other wells in common areas, such as to establish or identify patterns or trends common to more than one well within a producing property lease or field.

Figure 4:
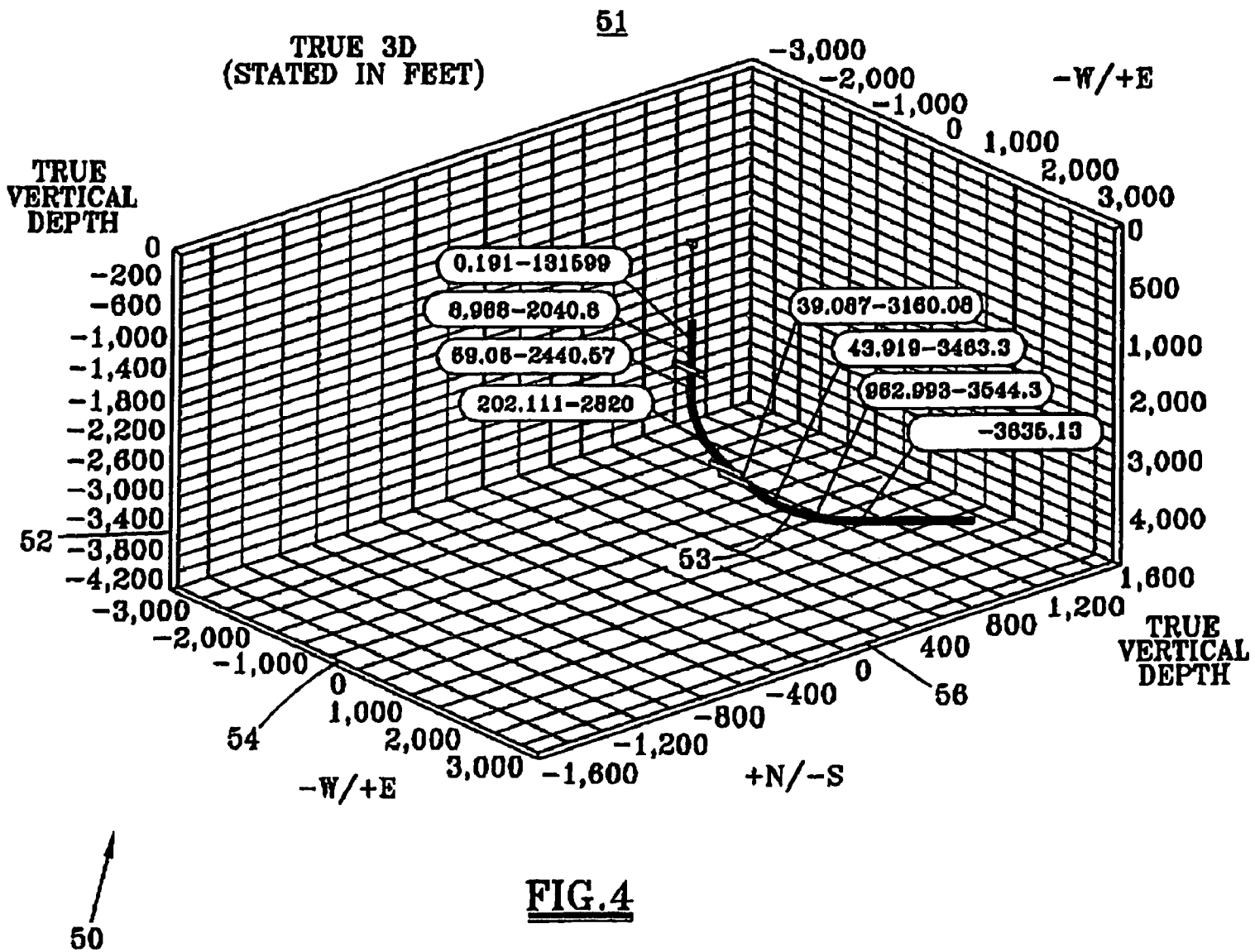
FIG. 4 conceptually illustrates a three-dimensional plot of the wellbore, along with rod wear and/or tubing wear data.
Figure 5:
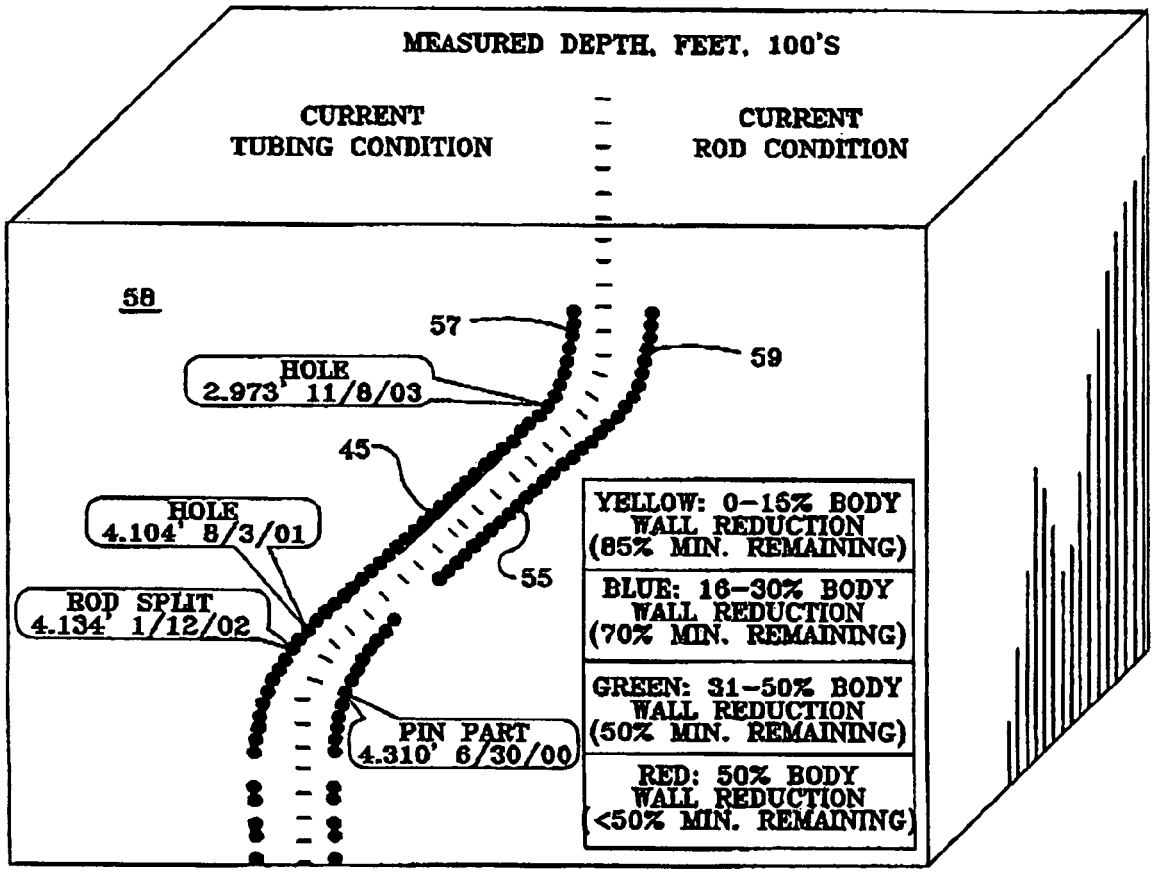
FIG. 5 conceptually illustrates another plot of the wellbore, along with rod wear and/or tubing wear data.

Having been stored on the server computer 16, all the data assembled in the rod profile, tubing profile, and deviation profile may be communicated and analyzed by means of a graphical database, in countless formats. For instance, the individual profiles may simply be displayed individually in a two-dimensional display. Such a display would only minimally show a correlation between the data, in that all three profiles may be viewed independently, without interrelating them. To provide a more useful analysis, the data from the three profiles is preferably correlated, in that data from one profile is related to data from another profile. As shown in FIG. 4, for example, a three-dimensional display 50 may be viewed on a screen 51, comprising a plot 53 of the wellbore's physical path or deviation profile, where a vertical axis 52 represents depth of the well, and two horizontal axes 54, 56 define a plane parallel with the earth's surface above at the well site. Critical areas of the wellbore plot 53 may be graphically identified or labeled with the rod data and/or tubing data. The plot 58 of FIG. 5 shows another plot example, wherein one wellbore deviation profile 57 is displayed and labeled with tubing data, and another wellbore deviation profile 59, identical to profile 57, is labeled with rod wear data. Many other types of display are possible, wherein data from two or more of the rod profile, tubing profile, and deviation profile is plotted, compared and interrelated.

In one embodiment, an image is created for real-time display of the individual lengths of production tubing, and the sucker rod in the well, by sub depth and circumferential position, thereby displaying flaws on both the rod and tubing while being pulled from a wellbore at the well site. The image is created from signal amplitude, precise location as to depth within the wellbore and position around the circumference of the tube and sucker rod. A signal may be obtained at any desired depth interval, e.g., every foot or every meter. The system provides an accurate representation of the entire tubing or rod string as to depth, flaw size, geometry, wall thickness (as appropriate), radial position and depth within the wellbore. A significant advantage of such a "real-time" image display of a cross-section of the tubing string or rod string as it is being pulled from the well is that a technician trained in the analysis of such images is able to apply human interpolative skills to confirm the image of flaws generated by the imaging software in the computer. This allows for fast classification of individual lengths of tubing or sucker rods, as pulled from the well.

The image produced by the computer may be transmitted on the internet and may be accessed by another internet compatible computer to remotely display the visual representation. A computer at the well or a remote computer may produce a data file, table, or database which may then be accessed through the internet by another computer. A database may be used to remotely display the visual representation, using a graphical viewer operating on the remote computer.

The software system may display 3-dimensional images from multiple wells with the surface location of each well displayed relative to other wells so as to compare the data from one well to other wells in the same producing reservoir.

Figure 11:
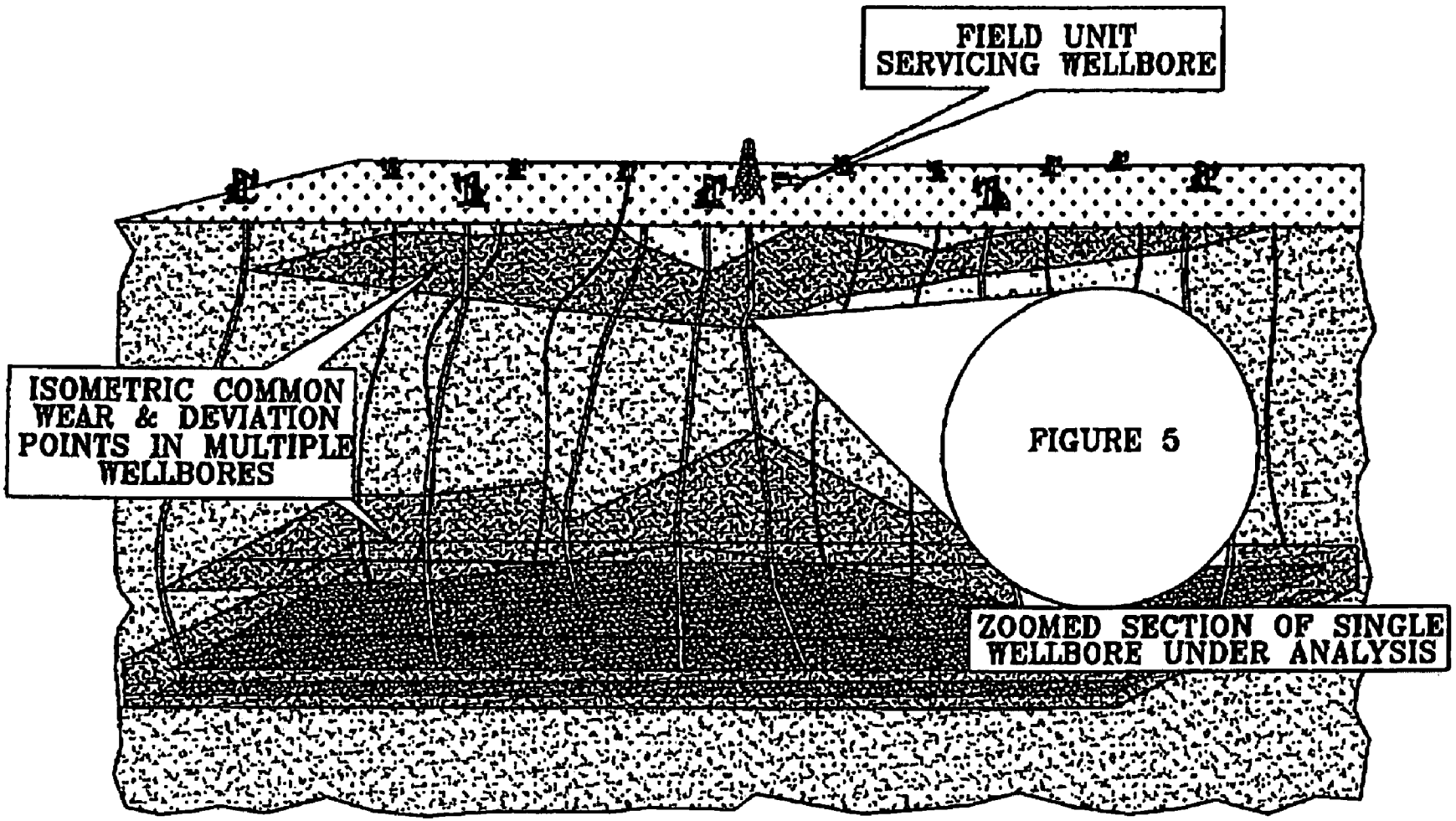
FIG. 11 conceptually illustrates a 3-dimensional image of a producing area lease or field, including the surface location, depth, deviation, as to both inclination and azimuth, rod condition and tubing condition.

It is a benefit of the present invention that conditions of multiple wellbores within a common producing field, lease, or area may be correlated and imaged, such as by using color-based common data isogram mapping, which may be applied to a visual display such as shown in FIG. 11. The database also allows for comparison to other databases having historical operational failure data for the multiple wellbores. The entire volume of information relevant to the failure history, root cause of the failure, tubing profile, deviation profile and rod profile may be stored, analyzed, correlated and graphically presented. This entire database can be investigated by any authorized user with internet protocol access, as well as displayed at the field. This feature allows for a rapid, graphic display of relevant wellbore conditions both in specific wellbores and multiple wellbores within the producing area lease or field. The optimum wellbore wear mitigation solution is generated and readily displayed and analyzed at any location, as well as in the mobile field unit containing data acquisition computer system 14. An operator may thus rapidly implement the wellbore wear mitigation solution before the well is put back into production.

Figure 2:
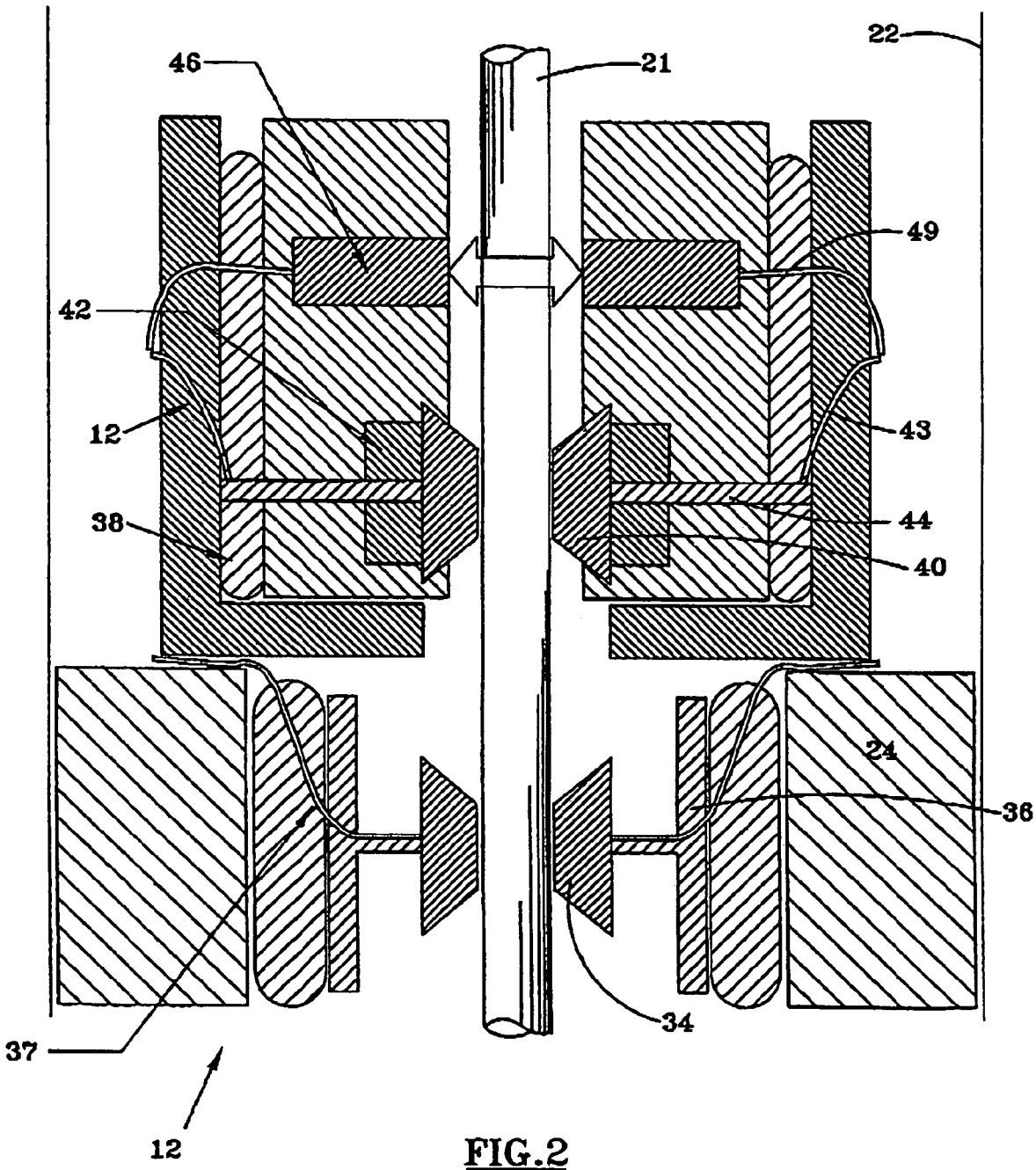
FIG. 2 conceptually illustrates some of the components that may be included with the sensor package, including a magnetic flux leakage sensor coil, a Hall effect device, an LVDT, a laser micrometer and a laser triangulation sensor.

FIG. 2 details one embodiment of sensor package 12. A generic cylindrical member 21 represents either the rod string 18 or tubing string 20 being examined. Many elements of the wear evaluation system 10 are generally known. For example, magnetic flux leakage sensor coils and Hall effect sensors are known in the art to detect and measure changes in magnetic flux density caused by corrosion pitting, wall thickness change, cross-sectional area change and fatigue cracks on production tubing, sucker rods and on COROD sucker rods. Magnetic sensors are also known for detecting area and changes in area of COROD, and diameter or change in diameter of rod and tubing. LVDTs are also generally known in the art for determining diameter and thickness of specimens. Magnetic coil 24 is radial spaced from tubing 20 or rod 18, to magnetically energize the tubing 20 or rod 18 without touching them. Magnetic sensor shoes 34 are radially movable with respect to tubing 20 or rod 18 via floating, bi-directional sensor shoe mount assembly 36. The floating shoe mount assembly 36 allows freedom of movement as the irregular surface of the tubing 20, rod 18 or coupling 19 pass through it. The sensor shoes 34 may contain magnetic flux sensor shoes or Hall effect devices to sense flux leaking from the rod 18 or tubing 20, generating signals in response. Signal wire 37 passes signals from the shoes 34 to the data acquisition computer system 14 or elsewhere in the sensor package 12. While the sensors disclosed herein may be movable relative an outer enclosure which houses the sensors, such as barrell 22, the sensors are not gimbaled for rotation relative to the enclosure, but rather are "strap-down" sensors, as discussed above, which are not rotatable relative to the enclosure.

Above the magnetic coil 24 in FIG. 2 is LVDT 44. Another contact shoe 40 floats along the rod 18 or tubing 20, moving radially in response to the diameter of the rod 18, coupling 19 or rod guide 35. The signals are output via signal wire 43 to the data acquisition computer system 14 or elsewhere within the sensor package 12.

Above the LVDT in FIG. 2 is a laser micrometer and/or laser triangulation sensor and receiver pair 46 for measuring the diameter or change in diameter of sucker rods, sucker rod couplings, and sucker rod guides. Although laser micrometer and/or laser triangulation sensors are known generally, their application to determining diameter of a rod as it is pulled from a well is considered novel. In one embodiment, the laser micrometer includes a laser triangulation sensor, or multiple laser triangulation sensors, to measure the diameter of the components of the string. A plurality of such sensors may thus each measure the distance or stand off from the sensor to the surface of the sucker rod at selected circumferential locations about the sucker rod string. Power and signal wire 49 powers the laser micrometer and/or laser triangulation sensor and receiver pair 46 and passes signals to the data acquisition computer system 14 or elsewhere within the sensor package 12.

In FIG. 2, sensor insert 26 is shown to house both the LVDT 44 and laser micrometer and/or laser triangulation sensor 46. The sensor insert 26 may be changed out to accommodate various diameters of rod and tubing. For example, the insert 26 shown may be suitable for ⅝", ¾", ⅞", or 1" rods, and a larger insert may be inserted into barrel 22 for rods greater than 1" or for tubing. The magnetic coil 24 in this embodiment is not included within the sensor insert 26.

The sensor package 12 of FIG. 2 is conceptual and not to scale, for the purpose of illustrating its features. If constructed with the proportions shown, the couplings 19 for coupling sucker rods 18 may interfere with floating shoes 34 and 40. When passing coupled rod string 18 through the sensor package 12, it may therefore be necessary to move the shoes 34, 40 outwardly, to prevent this interference. Accordingly, suspension system 38, consisting of pneumatic bladder or cylinder elements or alternatively, springs, is used to allow this outward radial movement. Magnetic sensor coil and Hall effect device shoes 34 may be radially spaced to remotely detect wear to the rod string 18 and couplings 19, such as from 0.25" from the rod or tubing surface, to prevent interference with the couplings 19. Further, because the laser micrometer and/or laser triangulation sensor 46 is capable of remotely sensing the rod, use of the laser micrometer and/or laser triangulation sensor 46 may obviate the need for the LVDT 44. A major advantage of using laser micrometer and/or laser triangulation sensor 46 over prior art diameter measurement systems is this ability measure the considerable variance in diameter of rod string 18, coupling 19 or guide 35 without touching them.

Figure 3:
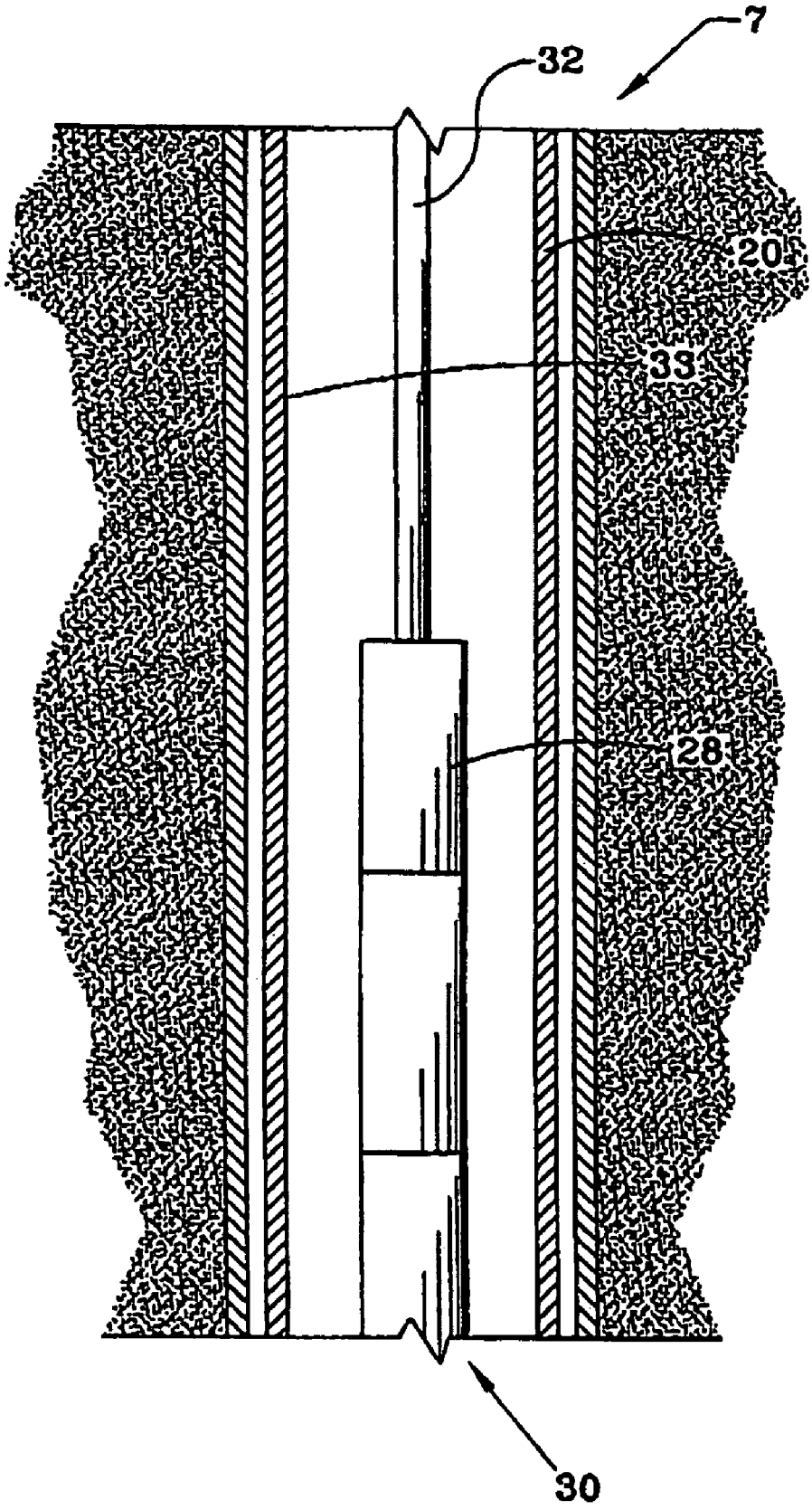
FIG. 3 conceptually illustrates a portion of a well in which casing is cemented, with the production tubing string suspended within the casing, and the deviation sensor being moved through the wellbore within the tubing.

The deviation sensor 28 in FIG. 3 may comprise as many as three or more pairs of inclinometers (accelerometers) and gyroscopes, both known in the art. The inclinometer is a lower cost, accelerometer-based device that generally provides only inclination angle data. The gyroscopes provide azimuth data, which could detect, for example, a corkscrew deviation that may be undetectable solely with the inclinometer. Conventional gyroscopes, however, are typically a far more expensive devices. Although the additional information provided by a gyroscope is useful, lower cost gyroscope technologies are currently sought.

The deviation sensor tool 28 may specifically contain three sets of paired micro electrical-mechanical systems (MEMS) Coriolis-effect angular rate gyroscope and accelerometer devices known in the art of inertial navigation and shock measurement. Such devices are not known to have been employed in surveying existing, producing oil and gas wellbores for obtaining a deviation profile. Each pair of MEMS gyroscope and accelerometer devices, respectively, is triaxially positioned orthogonally to each other in the planes X, Y and Z. By initializing the deviation sensor tool relative to an established frame of reference using conventional Cartesian coordinates with a Global Positioning System, and using onboard processing and memory, it is possible to integrate rate of angular change over time into position. The deviation tool or package is thus able to record the inclination and the azimuth of an existing, producing wellbore. The present invention uses less robust, lower operating temperature-capable mass produced Corioles-effect MEMS devices rather than expensive alternative technology Coriolis-effect gyroscopic devices so as to bring the cost below that of a MWD directional survey or multi-shot wireline survey performed during the drilling of a wellbore. By comparison, an entire wellbore evaluation according to the present invention, including computation of rod profile, tubing profile, and deviation profile, may be obtained for less than the cost of a conventional gyroscopic survey. This highlights an important advantage of the invention that, by comparison to current techniques, an exceedingly more comprehensive wellbore analysis for wear, corrosion and deviation can be performed at an affordable price.

In one embodiment, the deviation tool or package utilizes three pairs of MEMS gyroscopes and MEMS accelerometers, positioned orthogonally to each other, to form the basis of a producing wellbore deviation tool. Each pair of a MEMS gyroscope and MEMS accelerometer are positioned in a common plane. The package includes a pressure housing which contains a power supply, e.g., batteries; a microprocessor-controller containing an integrated analog to digital converter and system clock; a system memory to record the output from the accelerometers and gyroscopes, and the MEMS devices.

In order to locate the surface position of the tool, a GPS module may receive satellite positional information to determine position and orientation, thereby establishing the initial position of the tool prior to insertion into the wellbore. The deviation of an existing, previously-drilled, producing wellbore may be determined in three axes, i.e., X, Y & Z, using the three pairs of orthogonally positioned integrated, single chip MEMS Coriolis effect gyroscopes, and three pairs of integrated, single chip MEMS accelerometers as single or dual axis tilt sensors, so as to determine the deviation from vertical in both an azimuthal axis and an inclination axis relative to its surface location. The tool may continuously measure and record the tri-axial deviation of an existing wellbore using the MEMS Coriolis effect gyroscopes and MEMS accelerometers. These devices may input signals to an onboard microcontroller within the tool, and the measurements recorded in an onboard memory within the tool. The deviation sensor 28 may be inserted into production tubing of an existing wellbore and thereby determining the continuous azimuth and inclination of the tubing in situ with the well, without removing the tubing. This information may be passed to the central microcontroller-processor. As the tool is lowered into and removed from the wellbore on a solid or braided wire, the three pairs of MEMS gyroscopes and MEMS accelerometers output analog voltage proportional to negative and positive angular rate and to negative and positive acceleration, respectively. These voltage outputs are then digitized using the integrated analog to digital converter contained in the microprocessor-controller. The onboard memory then records the output of the MEMS devices. Once the tool is removed from the tubing string, the onboard memory may be downloaded to a surface computer. This data is integrated over time and converted into wellbore inclination and azimuth positional information in a manner well known in the art of inertial navigation and wellbore surveying. A deviation profile of the well is then mapped and imaged in the computer, and a printed plot may be obtained.

The radius of curvature of the production tubing (commonly referred to as "dogleg" severity) can be estimated, and may be used to predict side loads between the sucker rod string and production tubing string. The probable locations of rod-on-tubing mechanical wear can thus be determined. Kinks and sags in production tubing within the casing of a previously-drilled producing well may be determined, frequently as a result of failure to adequately pre-load the tubing during installation. The probable points of rod-on-tubing mechanical wear may thus be determined.

Figure 12:
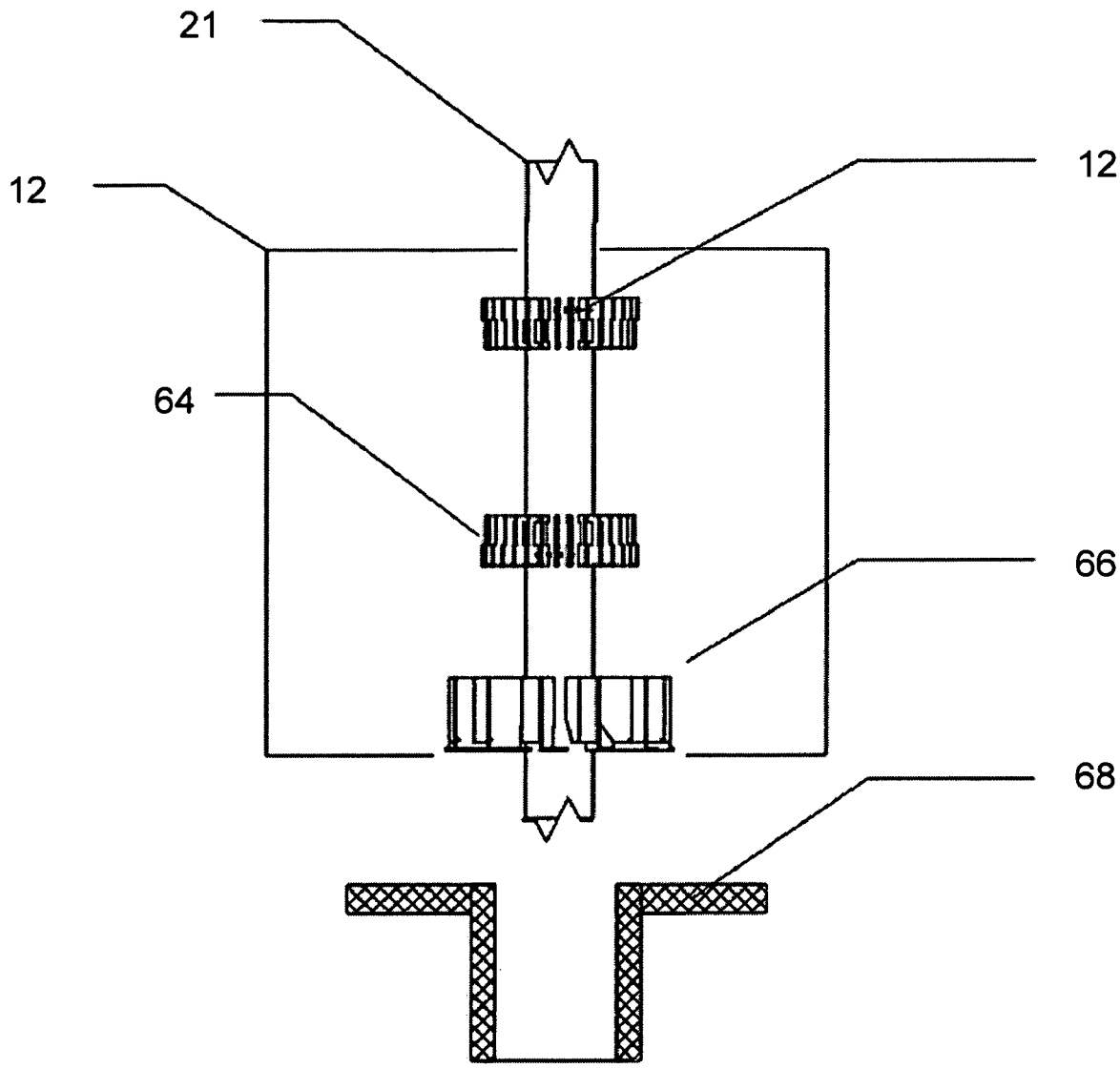
FIG. 12 illustrates a side view of sensors at a well site.
Figure 13:
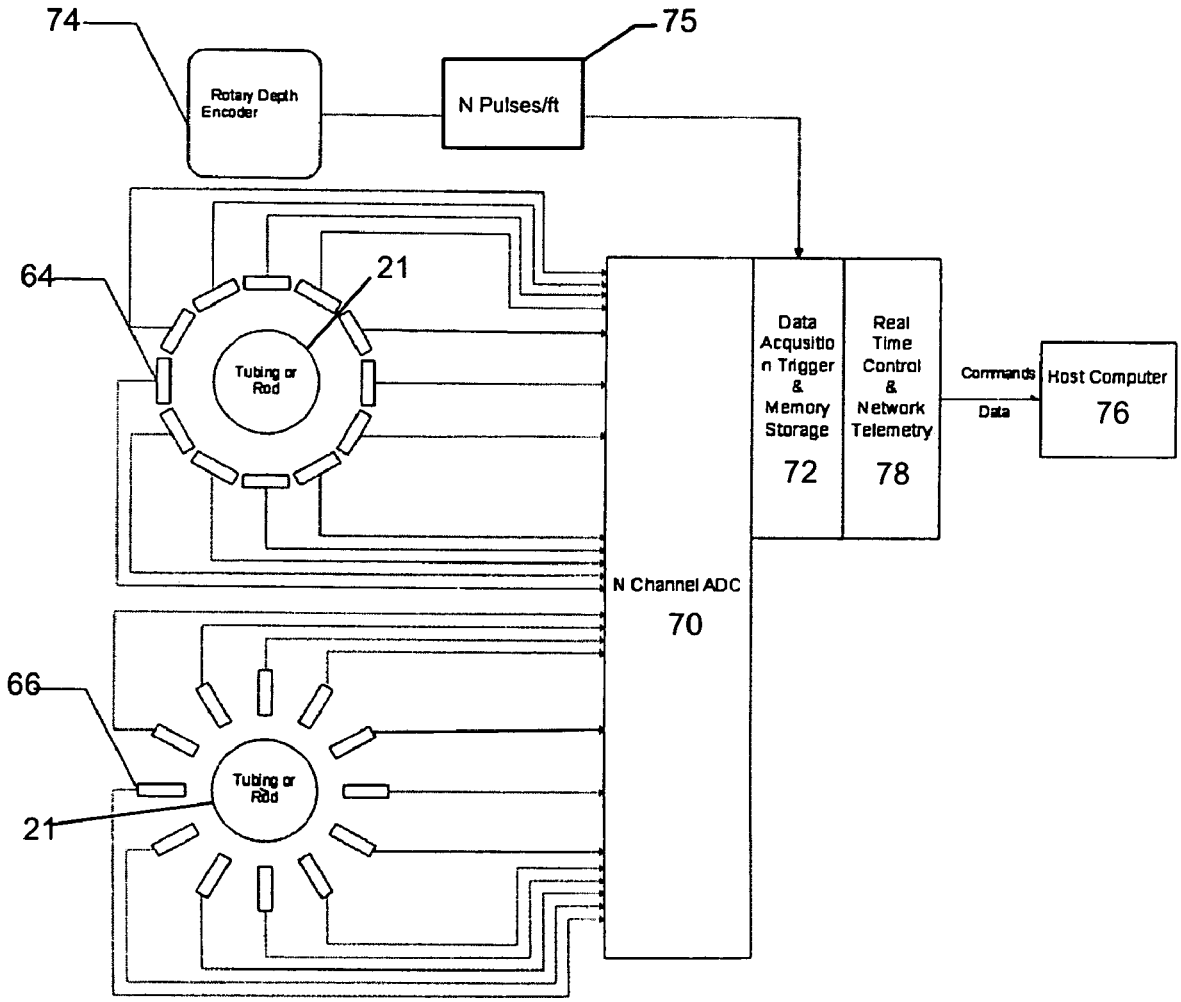
FIG. 13 conceptually illustrates the surface sensors connected to a computer.

FIG. 12 shows in greater detail suitable surface sensors or sensor package 12 at a well site. FIG. 12 specifically shows that sensor package 12 includes a plurality of circumferentially spaced radial and axial Hall effect sensors 62 for wear and flaw detection, a second plurality of radial Hall effect or GMR sensors 64 for split hole detection, and lastly a plurality of circumferentially spaced standoff and centralization sensors 66 for determining the standoff between the sensors and the exterior of the object being examined. As shown in FIG. 12, each of these sensors is provided at the surface and above the wellhead 68 at the top of the well. As is conceptually shown in FIG. 12, a production tubing string or rod string 21 is being pulled upward from the well and through the wellhead while the measurements are being taken. The functional components of the tubing sensor package 28 are shown in FIGS. 12 and 13, with various sensors positioned circumferentially about a production string 21, and are shown spaced axially along the string for illustration purposes. Those skilled in the art appreciate although a tubing sensor package 28 is thus shown in FIG. 12, functionally the same sensors may be used in a different arrangement to provide a suitable rod sensor package.

Referring now to FIG. 13, the sensor package 62 and 64 and the standoff sensor package 66 are each shown in a top view, with a rod or tubing 21 positioned within the circumferentially arranged sensors. Each of the sensors is interconnected with an analog to digital converter 70, which feeds the information to a data acquisition and memory storage device 72. The rotary depth encoder 74 provides information regarding the depth at which the portion of the string being examined was position in the well, with this information going to a pulse unit 75 which then transfers information to the memory storage device 72. In this manner, signals from each of the sensors may be correlated to the depth of the well as the rod or tubing is pulled from the well. This information may be transmitted to a host computer 76 through a real-time control and network telemetry system 78, so that data may be transmitted to the host computer, and command from the host computer may be provided to the sensors.

Figure 14:
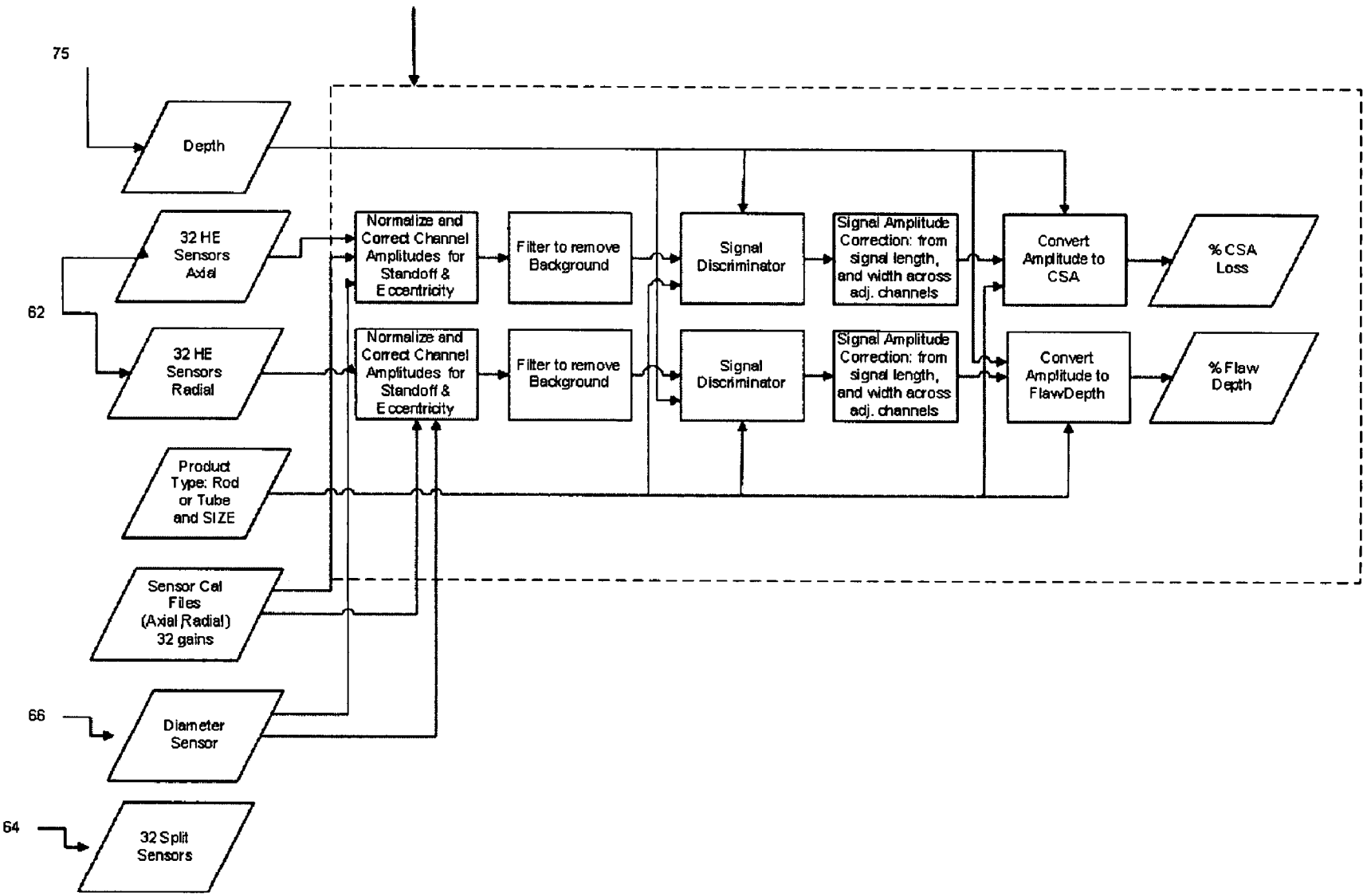
FIG. 14 illustrates a block diagram of signal processing according to one embodiment of the invention.
Figure 15:
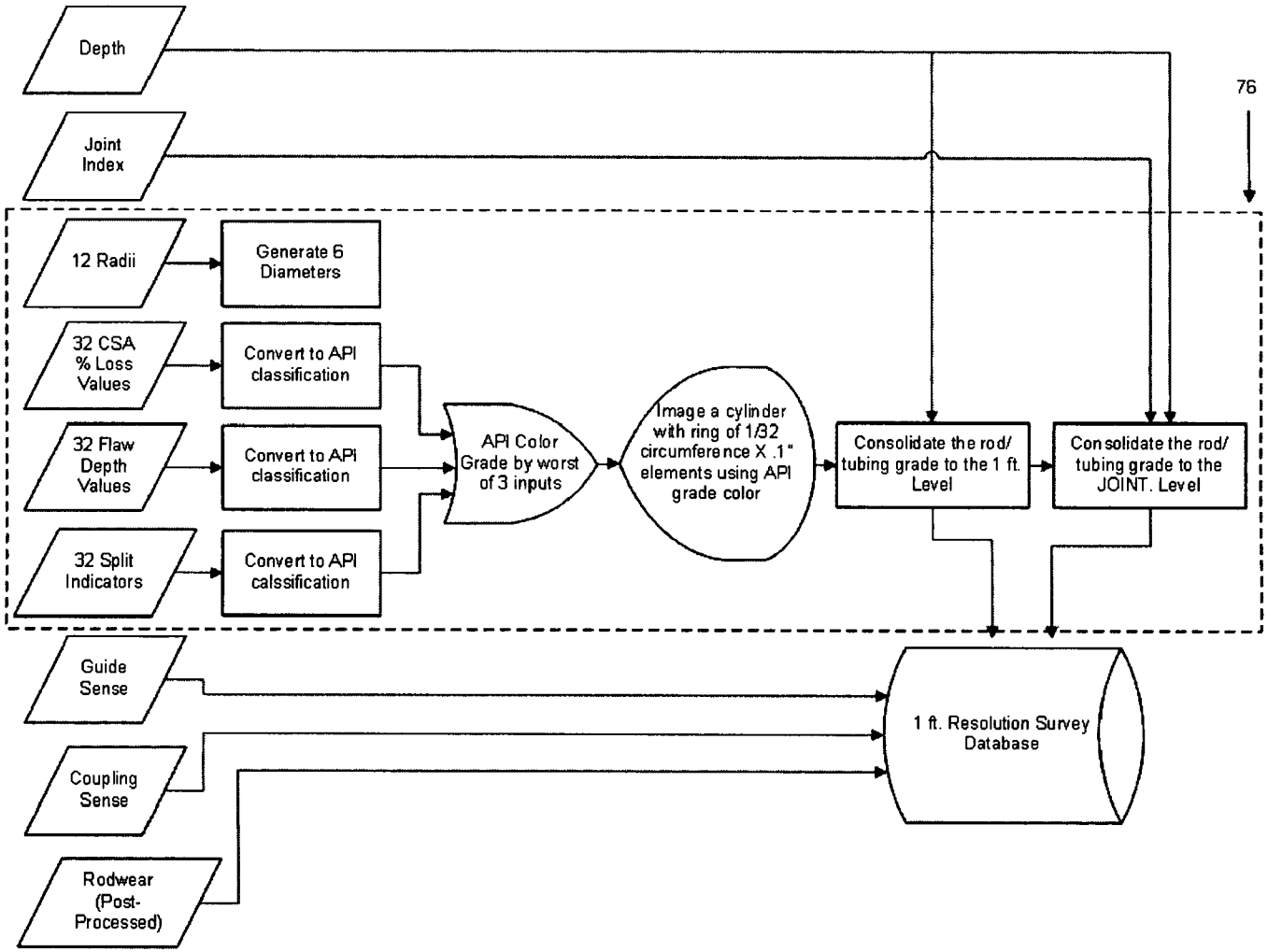
FIG. 15 is a process flow diagram or portion of the process according to one embodiment of the present invention.

FIGS. 14 and 15 are functional block diagrams of the data manipulation system according to the invention. For this embodiment FIG. 14 utilizes 32 defect sensors within each of sensor packages 62 and 64 for detecting defects in the string as it is pulled from the well. Defects are detected at established axial spacings, e.g. 1/10", and the sample rate preferably is selectable according to speed of the tubing or rod pulled from the well. In addition to the sensor package 62 and 64 determining defects in one of a production tubing string or a rod string, standoff sensor package 66 is preferably provided for detecting the standoff between each sensor in the sensor package 62 and 64 and the outer surface of the string. A minimum of 12 standoff sensors are preferably provided within the sensor package 66. For most applications, at least 24 axial sensors and 24 radial sensors may be employed.

The sensors may transmit data to the computer 76 in substantially real time, and the computer may compare signals from each of the sensors, 1-32, as a function of the depth of the portion of the string being examined and as a function of the circumferential position of each sensor in the sensor array 62 and 64. Similarly, sensors from standoff package 66 may be input to the computer 76, so that computer 76 may both correct the signals from the defect sensors as a function of the standoff, as explained above, and may also calculate the effective diameter of the string for that particular depth. This effective diameter determination provides valuable information with respect to both the nature and quality of the defects, and the location of the defects in the well. The computer may also calculate side loading on the string while in the well as a function of the severity of wear and dogleg severity of wellbore inclination and azimuth at particular depths. The computer may then output a plot of side loading as a function of depth, another plot of diameter as a function of depth, and a plot of the corrected defect signals as a function of depth. Each of these signals may also be plotted as a function of a particular circumferential position of one or more sensors within the array.

Signals from sensor packages 62 and 64 are processed through the blocks shown in FIGS. 14 and 15 by comparison of adjacent sensors; adjacent 1/10" axial spacings; normalization for standoff; filtering and signal discrimination to correct sensor output into a real-time image of the diameter; and determining cross-sectional area and wall thickness of the tubular or rod at any regular increments of well depth. Eccentricity and flaw depth information may be interpolated and imaged by the computer 76.

For many applications, the operator will desire both deviation information for the well and wear information for the string in the well, so that data from both types of sensors may be coordinated as a function of depth. In other applications, deviation data, i.e. inclination and direction, may not be necessary in order to make a reasonable evaluation of the quality and nature of the wear in the string. For these applications, the computer may thus receive information from the sensor package 64, and preferably also from the deviation package 66, so that a profile of the production tubing string or the rod string as a function of depth and as a function of circumferential position can be plotted, and thus individual lengths of tubing or rod may be classified as to condition in real-time as the tubing is pulled from the well.

Figure 16:
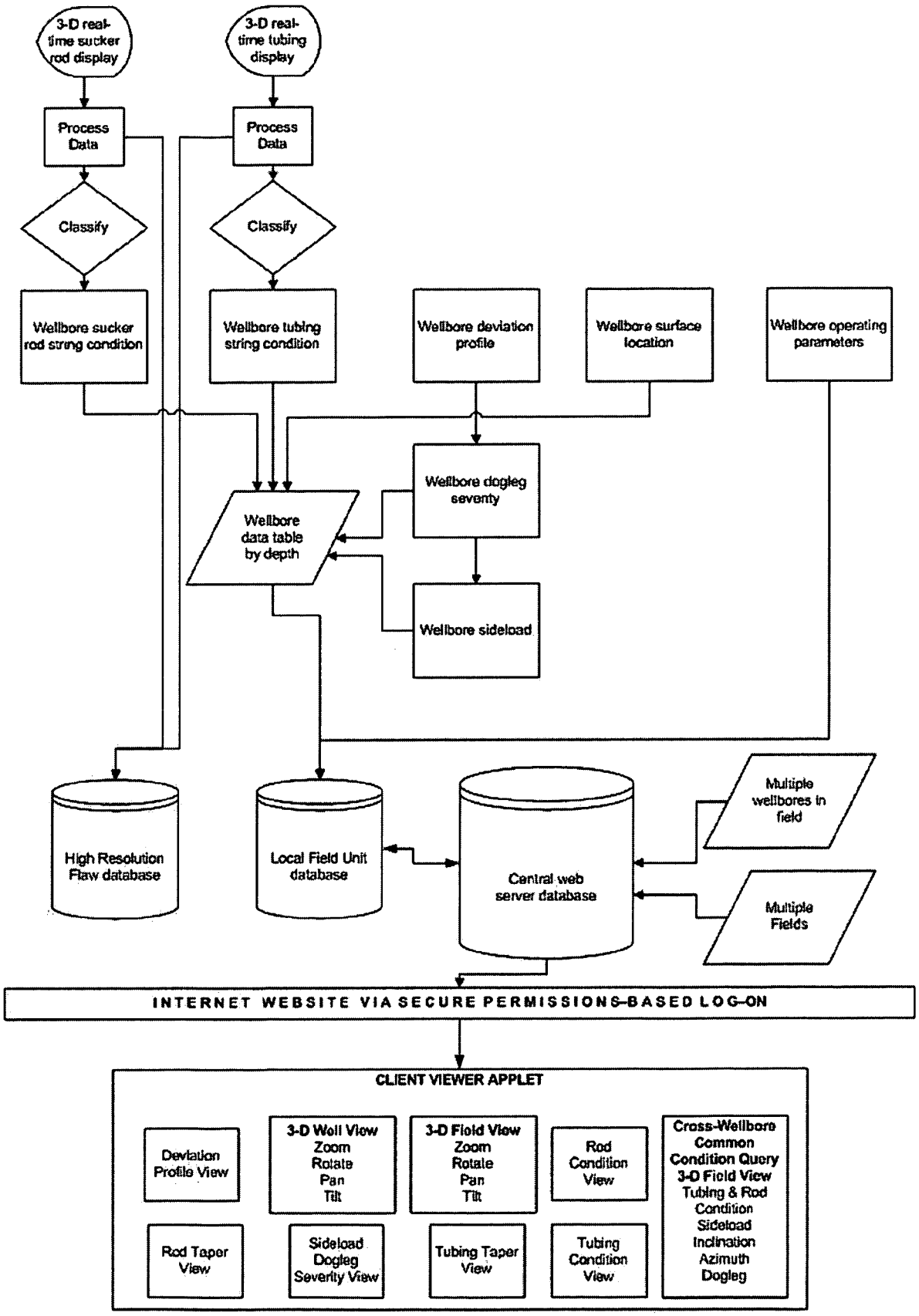
FIG. 16 is a deviation profile tool process block diagram.

FIG. 16 illustrates another process flow block diagram, with each of a 3D real time sucker rod display and 3D real time tubing display data input to process data and classify the relevant string. Wellbore sucker rod string and wellbore tubing string condition are thereby known for a particular depth. In the depicted embodiment, a wellbore deviation profile may be used to generate wellbore dogleg severity and side load information by depth. The tubing, rod and deviation profile by depth may be correlated with wellbore operating parameters, and this information used to generate a database table, which is then input to a central web server database, which has the capability of comparing similar information from multiple wellbores in a related field and/or wellbores from multiple fields. Processed data from the rod display and the tubing display may further be input to a high resolution flaw database.

Information from the central web server database may be transmitted via the internet for imaging in a client viewer. Deviation profile and rod taper may also be viewed by the customer, as well as 3-D well views, side load dogleg severity views, 3-D field views, tubing taper views, rod condition views, tubing condition views, and cross-wellbore common condition query 3-D views.

Figure 17:
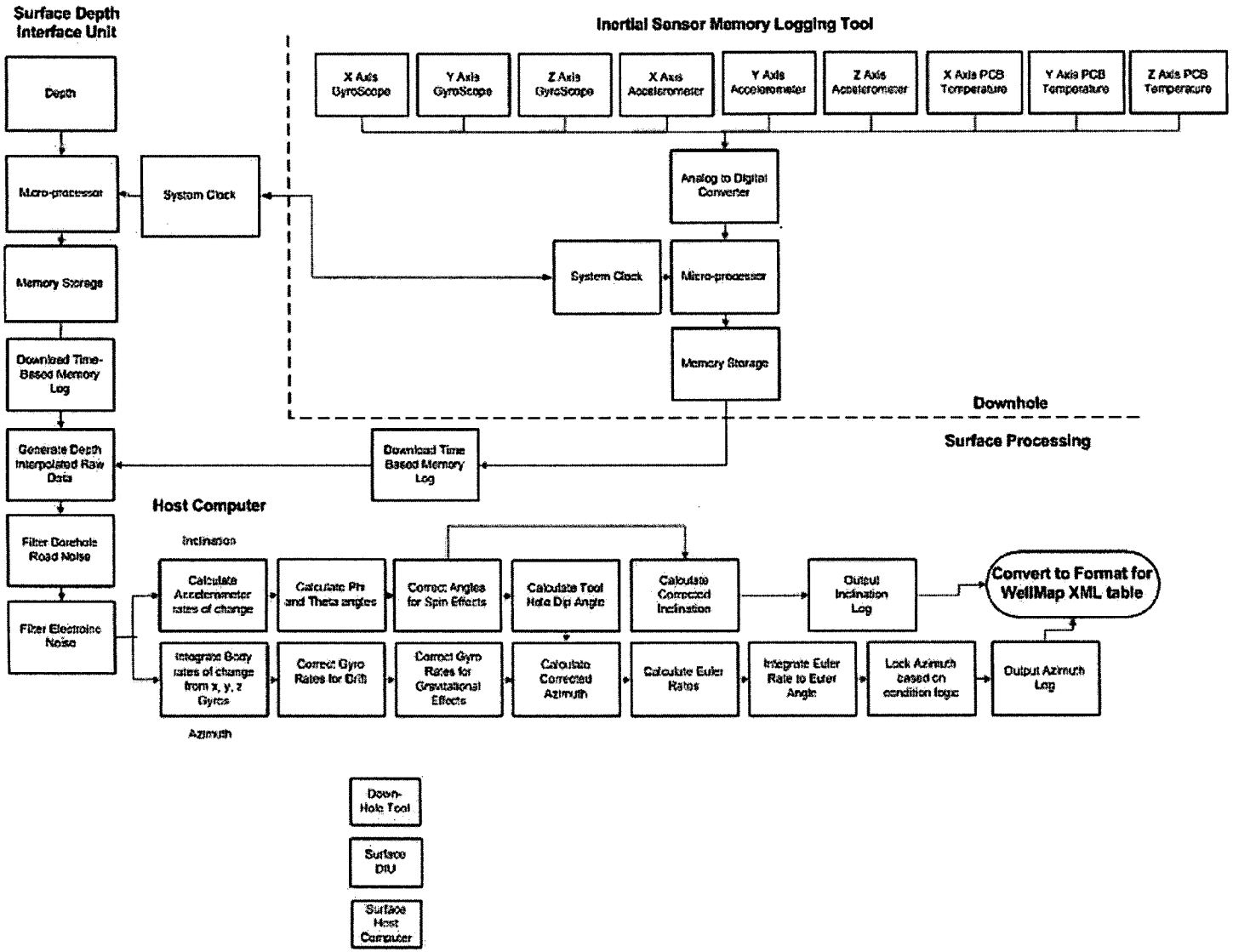
FIG. 17 is a process flow block diagram of the deviation tool process.

FIG. 17 is another flow diagram showing the processing of data from the X, Y and Z axis gyroscopes, and accelerometers, in a suitable inertial sensor memory logging tool. A surface depth interface unit may provide depth information to a microprocessor, and a clock system used to coordinate depth information with the information from the memory logging tool. Borehole road noise may be filtered, along with electronic noise. Both inclination and azimuth may be calculated by the computer, with inclination based on phi and theta angles, corrected angles for spin effects, and the tool downhole dip angle. The corrected inclination information may be output in the form of a log, and converted to a table for use by the user. Azimuth information may be corrected as a function of drift rates for a gyro and gravitational effects. The corrected azimuth calculations may then be output to an azimuth log, and similarly provided in table form for the customer.

The sensors detailed in the above figures are exemplary only, and conceptually illustrating the components that may be included with the wear evaluation system 10. The structure of the sensors is less important than the selection and use of the sensors and the integration and correlation of the data from the sensors. As alluded to previously, the prior art has generally sensed wear of the individual components, such as rod string segments trucked to a remote rod reclamation facility; COROD strings as pulled from the well; tubing strings as pulled from the well; and limited wellbore deviation information obtained during the original drilling of the well. The system correlates this information to obtain more comprehensive information than otherwise available upon separate analysis of the individual components, and performs this operation while all the components of the system remain at the well site. Thus, data from two or more sensors are selected from the group consisting of a deviation sensor movable within the well, either by the tubing as it is retrieved from the well or by wireline, to determine a deviation profile; a rod sensor for sensing wear, diameter, cross-sectional area and pitting of the sucker rod string, including couplings and guides, as it is removed from the well to determine a rod profile; and a tubing sensor for sensing wear, corrosion pitting and cross-sectional area of the production tubing string as it is removed from the well to determine a tubing profile. Some of these conceptually distinct sensors may be physically combined into a single sensor unit, such as sensor insert 26. Although analysis of even two of the profiles is useful, it is preferable in many applications to compute and compare all three of the deviation sensor, rod sensor, and tubing sensor information to determine a comprehensive wellbore profile. The server-computer 16 and/or data acquisition computer system 14 and/or logic circuits that may be contained within any of the individual sensors each may perform some subpart of this computation and comparison.

Integration and analysis of the rod, tubing and deviation profiles further allows for the computation of a wear mitigation solution to correct at least some aspect of performance of the well system. The wear mitigation solution can sometimes be derived by an operator upon viewing and analyzing data, such as displayed in graphical form in the display 50 of FIG. 4. However, such prior art requires an expensive deviation survey and does not include integration of tubing or rod conditions. Alternatively, the data acquisition computer system 14 and server computer 16 employed in the present invention provide a fast and comprehensive computation of the wear mitigation solution.

The wear mitigation solution may include strategically positioning rod guides 35 shown in FIG. 1 with respect to depth in the sucker rod string 18. In simple cases, an operator may simply move the rod guides 35 to locations where excessive wear in the tubing profile is observed. However, the observed tubing profile may be a result of wear induced in a well in which the tubing was previously employed and thus unrelated to wear patterns in this wellbore. Alternatively, under the present invention, the server computer 16 provides a more comprehensive solution, indicating for example a large number of wear locations for repositioning rod guides 35, based on correlations with other data such as the deviation profile. The wear mitigation solution may include lining the production tubing string 20 with a polymer lining 33, indicated conceptually between dashed break lines in FIG. 3. The solution may include using a powered tubing rotator to rotate the production tubing string 20, such as to better distribute wear within the circumference of the tubing string 20. A rod rotator may likewise be used to rotate the sucker rod string 18. The solution may further include changing pump size, stroke or speed; changing the diameter of a section of the sucker rod string 18; or replacing one or more segments of the production tubing string 20 or sucker rod string 18.

Figure 6:
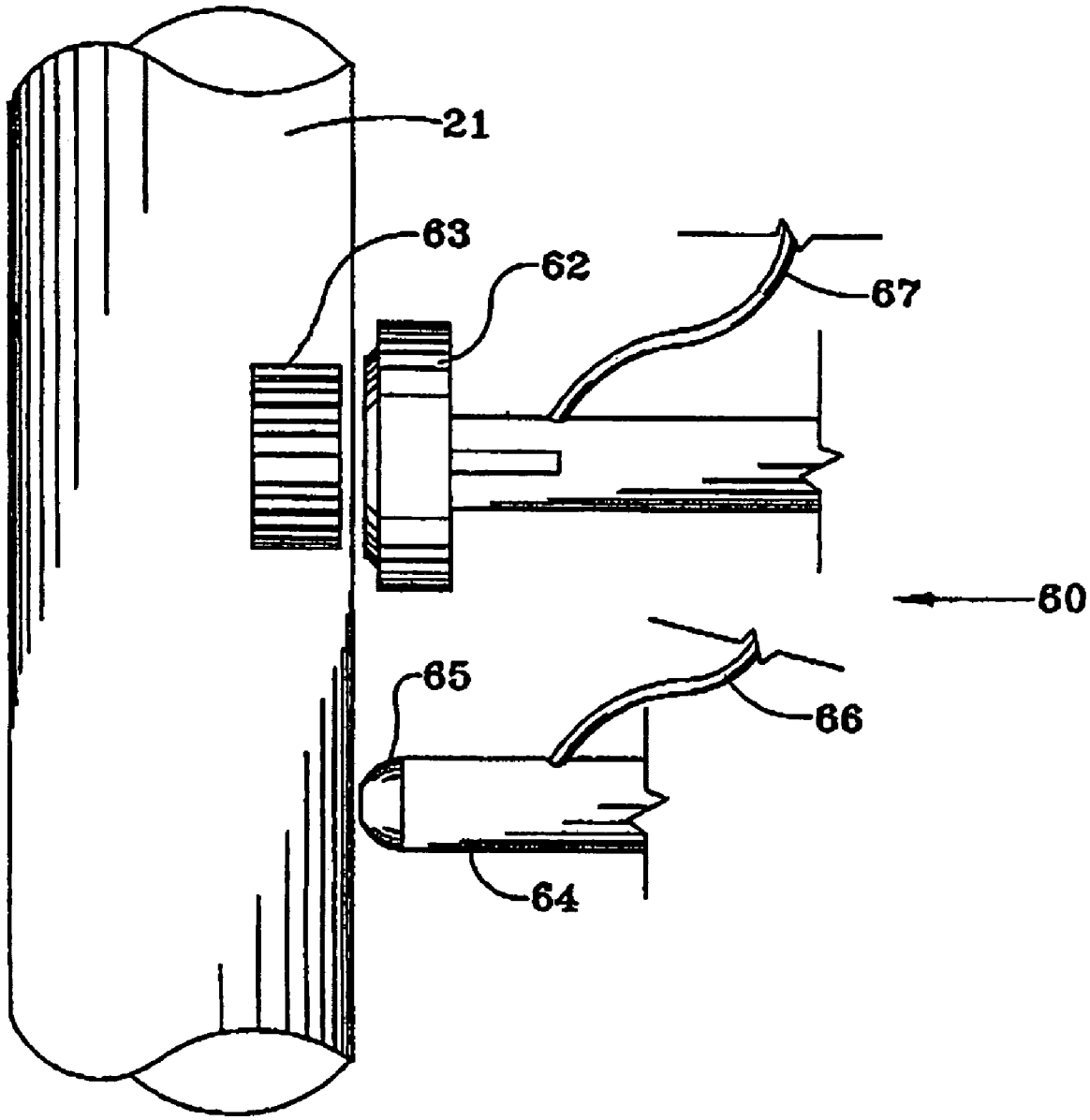
FIG. 6 conceptually illustrates a marking system, including a bar-code marking device for marking individual segments of the rod or tubing, and an optical reader for subsequently reading the bar codes, for tracking the individual segments.

The wear evaluation system 10 may further include a tracking system 60 detailed conceptually in FIG. 6. A marking device 62 may mark rod or tubing 21 with a bar code 63. In practice, the bar code 63 could be marked on an adhesive label as the surface of cylindrical member 21 is often rough, dirty, or otherwise incapable of directly receiving the bar code 63. A tracking device 64 includes optical sensor 65 for subsequently reading the bar code 63. The marking device 62 is preferably positioned above well 7 and marks individual segments of the production tubing string 20 and the sucker rod string 18 as they are pulled from the well 7. The tracking device 64 then reads the markings on the segments as they are reinserted into the well 7. A computer, which may be included within data acquisition computer system 14, is in communication with the tracking device 64 either wirelessly, or via wires 66, 67, for tracking the relative position of each of the segments of the respective production tubing string 20 and sucker rod string 18. The tracking system 60 thus allows the wear evaluation system 10, and specifically the server computer 16, to keep track of where individual segments are positioned within the tubing string 20 and sucker rod string 18. Because the segment positioning information gets stored in the server computer 16, it is of little consequence that the bar codes 63 may become illegible upon reinsertion into the well 7. In one embodiment, the markings comprise a Radio Frequency Identification (RFID) tags, in which case the tracking device comprises an RFID tag reader optimized for use when RFID tags are attached to the production tubing and/or sucker rods.

The tracking system 60 is useful when repositioning the individual joints of tubing, or rods and especially for future analysis of the elements of the same wellbore. For example, tubing joints having the greatest wear may be repositioned at the top of the string, and it is useful to keep track of this repositioning. Upon subsequent re-evaluation of the wellbore components at a later date, rod and tubing conditions may be compared and thus incremental wear and corrosion determined. Position information may be displayed along with other wear data. For instance, each tubing segment and rod segment may be represented respectively by one of dots 45 and 55 in FIG. 5. The dots 45 and 55 may be color coded, such as to represent their degree of wear. For example, tubing segments with 0-15% wall reduction (i.e. a minimum of 85% thickness remaining) may be represented by and displayed with a yellow dot, and placed at the lower end of the string; tubing segments with 16-30% wall reduction get a blue dot; segments with 31-50% wall thickness get a green dot; and segments with more than 50% thickness reduction get a red dot. A multiplicity of other coding and display schemes are conceivable.

Another aspect of the invention provides the significant advantage of evaluating rod wear to segmented sucker rod string 18 in the field. Prior art has been limited to disassembling segmented rod strings and evaluating them off-site, due to interference by the larger diameter couplings 19. According to one specific embodiment of the invention, a rod wear evaluation system 10 comprises a rod sensor included with sensor package 12 for sensing wear to the sucker rod string 18 as it is removed from the well 7 to determine a rod profile. Referring to FIG. 2 for illustration, the rod sensor 12 may comprise a magnetic flux sensor, including magnetic coil 24 and magnetic sensor shoes 34. The rod sensor 12 may also comprise a laser micrometer and/or laser triangulation sensor, including laser micrometer and/or laser triangulation sensor and receiver pair 46. According to this specific embodiment for evaluating segmented rod string 18, LVDT 44 is not included. The magnetic flux leakage sensor coil and Hall effect device, 34 and laser micrometer and/or laser triangulation sensor 46 are radially spaced from the rod string 18 and couplings 19 to remotely sense the diameter, wear, cross-sectional area and pitting of the sucker rod string 18. The data acquisition computer system 14 is in communication with the rod sensor 12 for computing the rod profile. Again, a plurality of differently sized sensor inserts 26 may be included for accommodating a plurality of diameters of the segmented sucker rod string 18, each sensor insert 16 including the rod sensor. Sensor barrel 22 optionally receives sensor insert 26. This embodiment senses and measures one or more of the presence of the couplings 19, wear to the couplings 19, diameter of the couplings 19, diameter of rod guide 35, rod diameter, rod cross-sectional area, and pitting.

Figure 7:
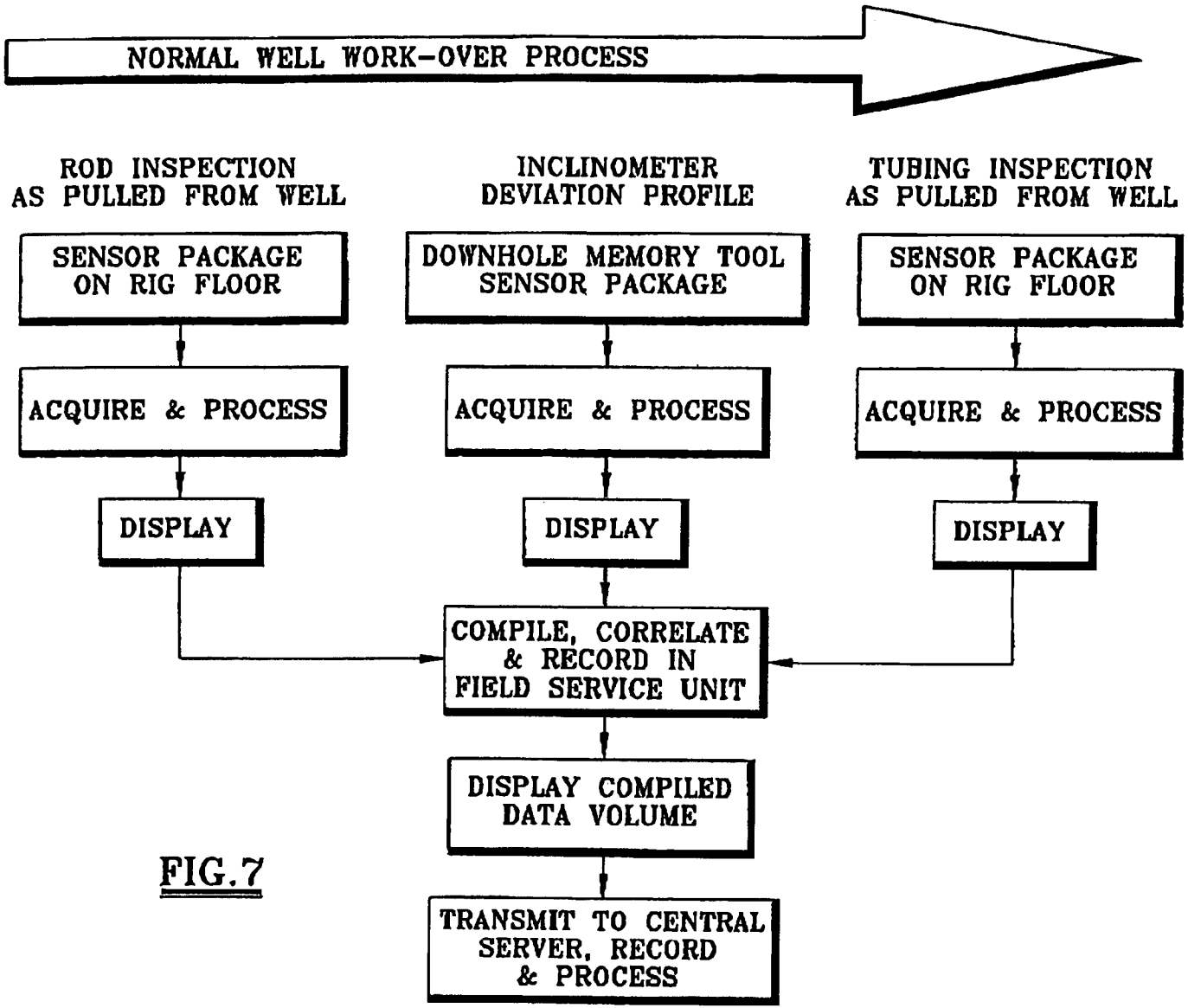
FIGS. 7-10 are flow diagrams conceptually illustrating examples of preferred operation of the wear evaluation system.

FIGS. 7-10 are flow diagrams illustrating examples of preferred operation of the wear evaluation system. FIG. 7 shows that rod, tubing, and deviation data are first acquired with their respective sensors, during normal well work-over operations. The data is optionally displayed, compiled, correlated, and/or recorded in the field, such as with data acquisition computer system 14. Again, some of these steps may not be performed until data reaches server computer 16, to which the data is transmitted. The server computer 16 may record the data, further process the data, generate the optimal wellbore wear mitigation solution and act as a server as discussed previously.

Figure 8:
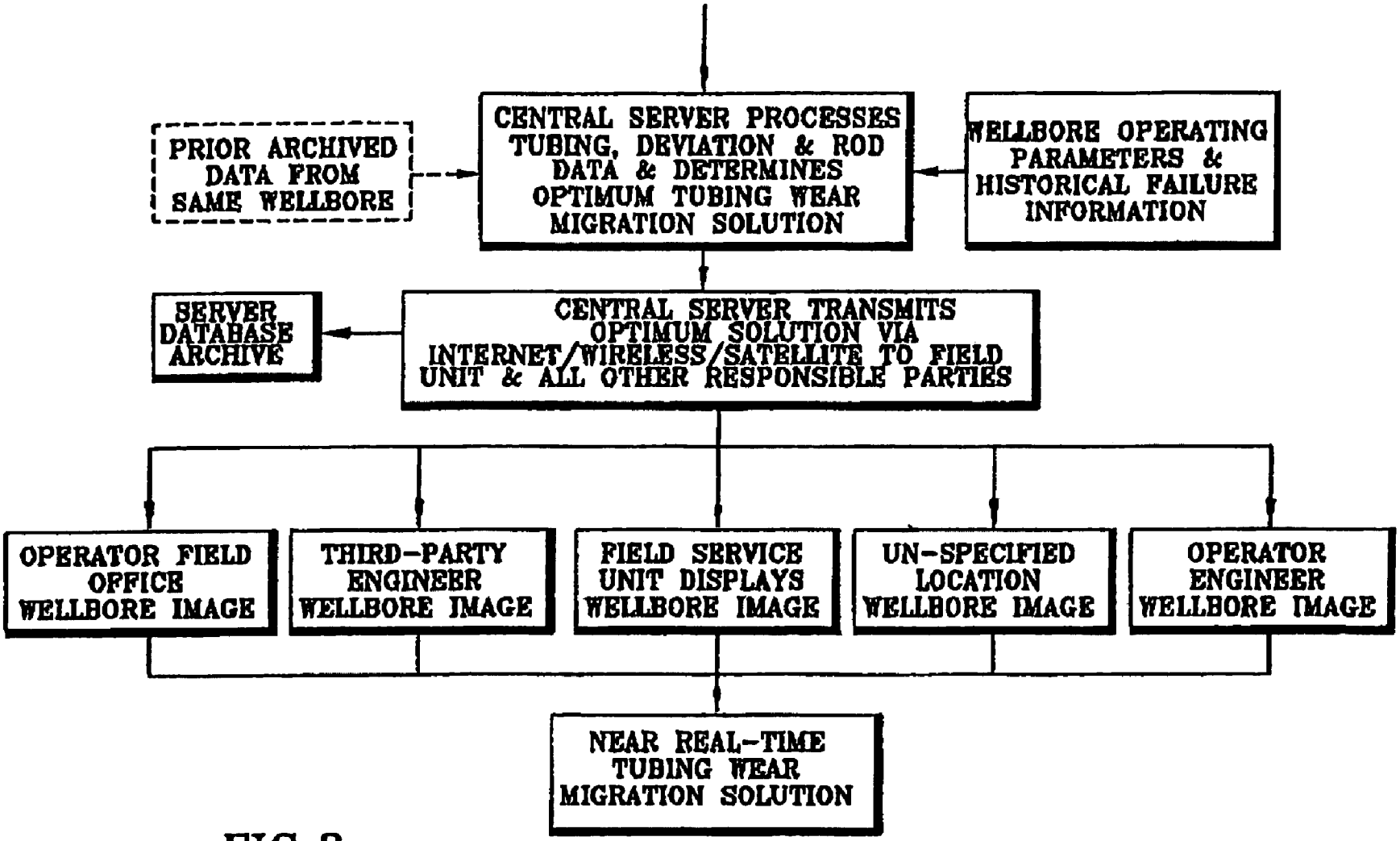

FIG. 8 illustrates that prior archived data from the same well, along with wellbore operating parameters and historical failure information, may be fed into the computer/server 26, which correlates the data and computes a wear mitigation solution. The server computer 16 then transmits the information back to the field, such as to data acquisition computer system 14, and to an archive database. The data may be made available to, displayed and interrogated by any authorized user of a computer with internet protocol access such as an operator field office, a third party engineer, a field server unit, another optional location to be specified, and an operator engineer, all at any location worldwide with authorization and internet access. This transmittal of raw data from the various sensors, through data acquisition computer system 14, to server computer 16, back to the data acquisition computer system 14 and any other location worldwide, via internet protocol, results in an internet published application of a real-time or nearly real-time wellbore wear mitigation solution.

According to one embodiment of the invention, an image is displayed of the production tubing and/or sucker rod string in an oil well, by depth and circumferential position, to display flaws on one or both of the rod string and the tubing string while being pulled from a wellbore at the well site. The image is created from components of signal amplitude, precise location as to depth within the wellbore and the circumferential position of the sensor with respect to the tube and/or sucker rod. The imaging system may thereby create a facsimile representation of the entire tubing and/or rod string as to depth, flaw size, geometry, wall thickness (as appropriate), radial position and depth within the wellbore.

The system disclosed herein provides for reducing the dependence of tubing or sucker rod condition classification upon magnetic flux leakage signal amplitude alone. By providing a larger number of circumferentially positioned sensors, digitizing the individual discrete output signals from each sensor within the computer, measuring sensor stand-off from the string under inspection, using high sampling rate digitization electronics for each sensor signal, sampling each sensor by depth, and constructing a real-time image of the sucker rod or tubing as the string passes through the sensor package, string classification may be significantly enhanced.

By comparing signals from individual sensors on both a radial and axial basis and using the axial positional information from a well depth encoder, the computer may build a series of stacked rings representing sucker rod or tubing elements from the producing wellbore. Color may be used to represent cross-sectional area and remaining wall thickness. A brief table representing the methodology used to build the image is shown below, as outlined in the process flow blocks of FIGS. 14 and 15.

| Function | Desired Attribute/Algorithm basis | Suggested Image |
|---|---|---|
| 1. C.S.A. Image average wall thickness at a single point on string as a ring | a. Color gradients of Y, B, G & R representing wall thickness<br>b. Ring height fixed at 0.1" on longitudinal axis<br>c. Radial component is a variable of value<br>d. Ring has constant I.D. & O.D. | 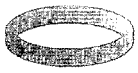 |
| 2. O.D. diameter & from 12 laser triangulation sensors | a. Frame ring built from 12 points<br>b. Establishes O.D. as fixed reference point for image<br>c. Ring remains colored according to 1<br>d. Identifies coupling<br>e. Sensitive to O.D. scale build up | 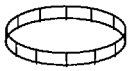 |
| 3. Pitting Image 32 individual HE sensors as "bricks" in ring from 1 | a. Each of 32 bricks has color gradients of Y, B, G & R overlaying 0.1" high C.S.A. ring<br>b. Radial dimension is a variable of value, at least for 4 major W.T. loss classes of 0-15%; 15-30%; 30-50 &; >50% | 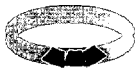 |

-continued

| Function | Desired Attribute/Algorithm basis | Suggested Image |
|---|---|---|
| 4. Rodwear Image data from multiple events of 1 & 2 with long, axis component input from encoder | a. Recognizes patterns along longitudinal axis from 1, 2 & 3<br>b. Longitudinal axis algorithm built from depth encoder<br>c. Stacks multiple rings from 1 to form tube with intelligence thru 4a & 4b | 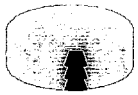 |
| 5. Split Detect and image O.D. split from E.C. sensors | a. Eddy current + input from 1<br>b. Overrides 3<br>c. Longitudinal component is function of depth encoder | 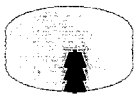 |
| 6. Complex | a. Builds tube from multiple stacked colored rings & bricks imaged in 1, 2 & 3<br>b. Further correlates 1 and 4<br>c. Repeated events of 3 exceeding threshold, without significant deviation in 2, implies I.D. pitting<br>d. Process 2 & 3 into algorithm for O.D. scale with pitting<br>e. Rate of change in value & relationships in values in adjacent rings of 1, 2, 3, 4 & 5. | 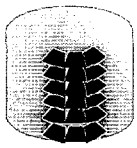 |

Figure 9:
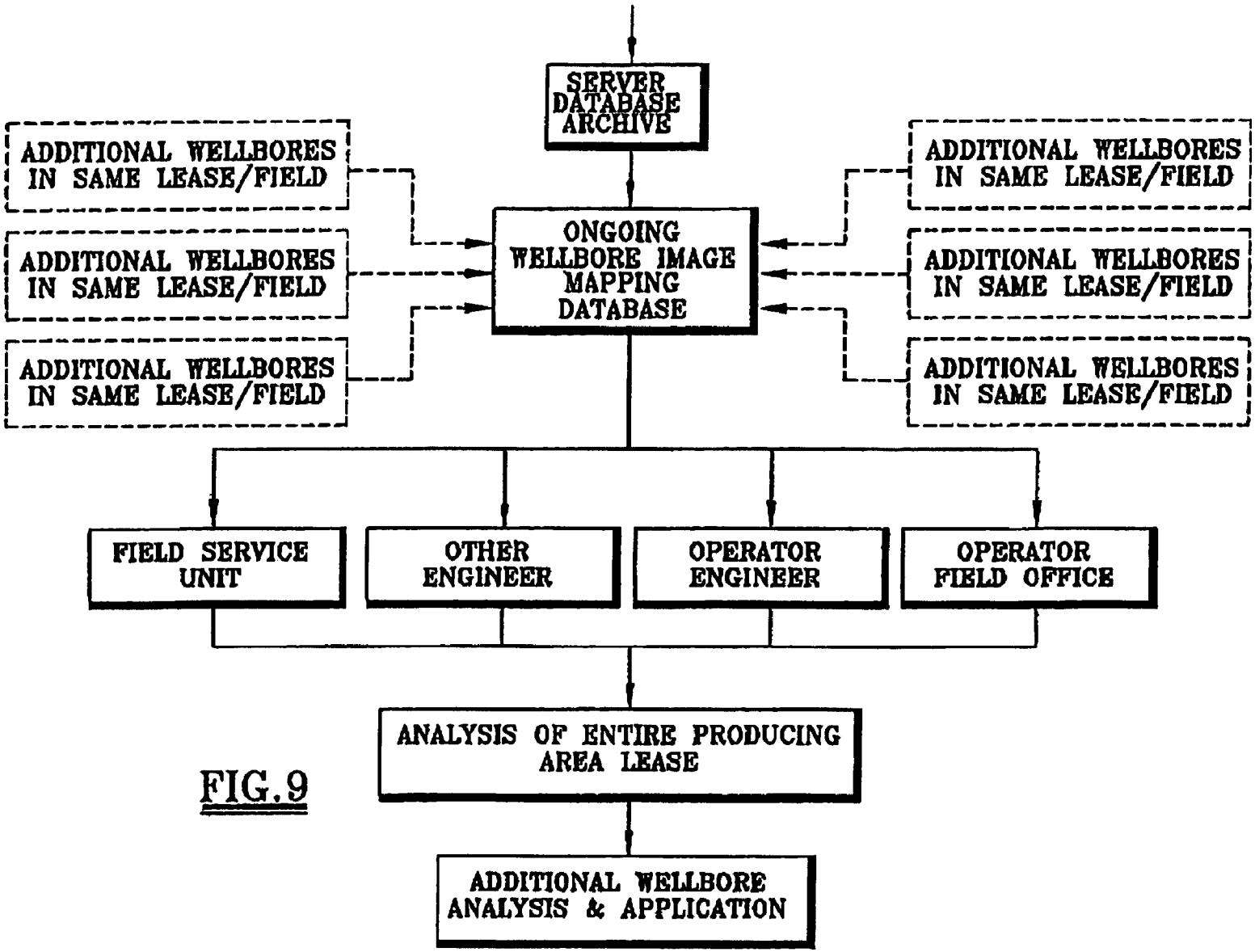

FIG. 9 illustrates how the wear evaluation system 10 may more broadly integrate raw and processed data to more comprehensively apply a wear mitigation solution. A variety of sources may feed the computer/server 26, such as the server database archive and simultaneous data from additional wellbores in the field and their corresponding wear evaluation sensors and systems. This culminates in an ongoing wellbore image mapping database, which may feed the field service unit, the operator engineer, other engineers, and the operator field office. The net result is a thorough analysis of the entire producing lease or field, including single wellbores in the lease or field, which may be simultaneously analyzed by multiple persons so as to provide a collaborative environment and thereafter continually analyzed and refined during the life of the lease and beyond. It is a benefit of the present invention that additional wellbores within the same lease may be evaluated by the system and also imaged within the isogram mapping capability of the system using internet protocol published application.

Figure 10:
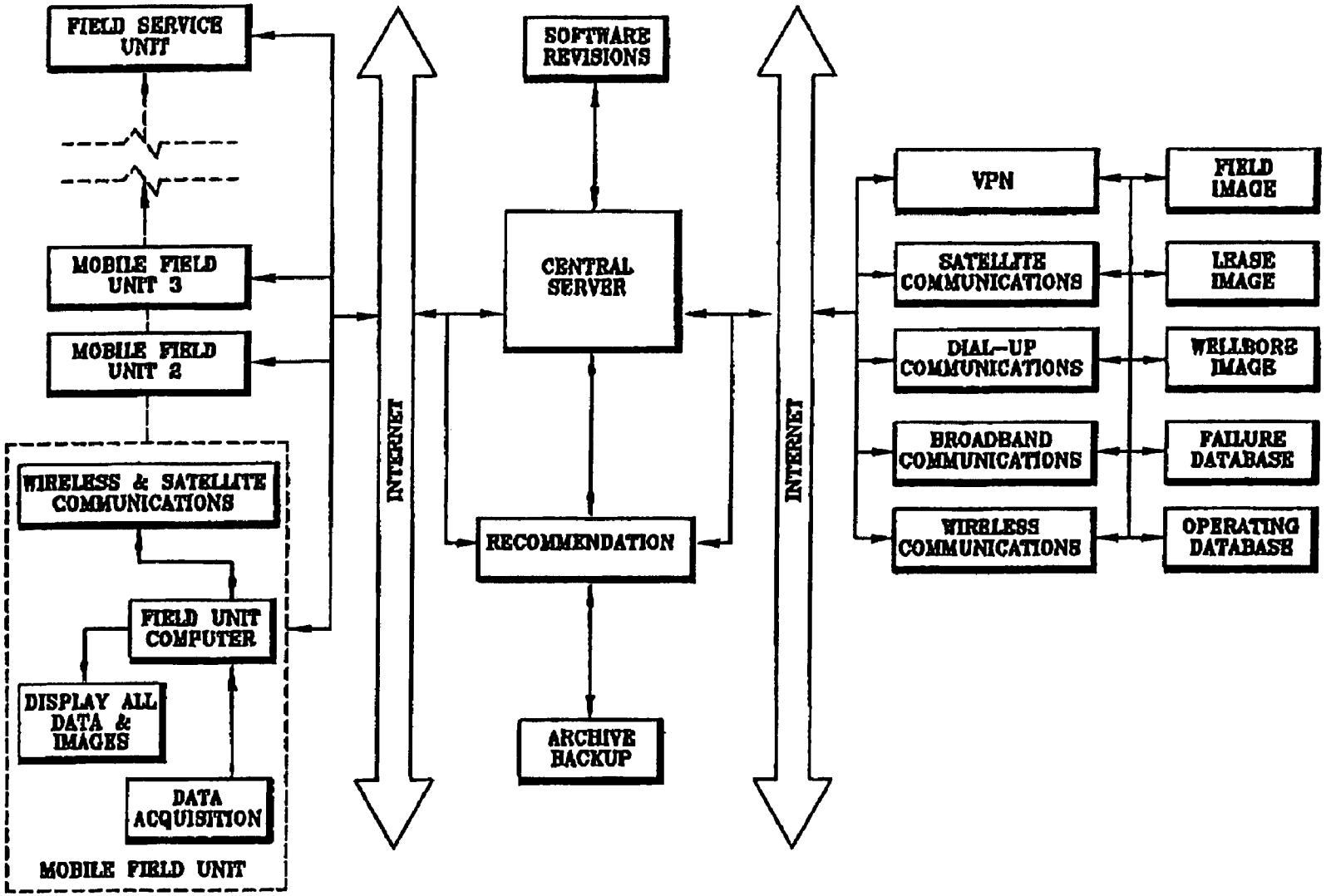

FIG. 10 is a diagram of a suitable system connected between a mobile field unit and a command location.

In one application, the deviation is retrieved with the normal workover process conducted to remove the tubing string from the well. The tool may be located in a landing nipple or seating sub at the lower end of the tubing string. The dropping speed of the tool may be retarded by utilizing one or more wire brushes that contact the inside surface of the tubing, or using scraper cups which also contact the inside surface of the tubing, or using parachute centralizers.

The tool may be retrieved from the bottom of the wellbore as the tubing is pulled to the surface by the workover rig. Tubing string lengths generally comprise two 30' sections between a breakout of the string. This results in a deviation or inclination tool standing stationary for a short period while the threaded connections are broken out. The tool may measure deviation of the wellbore both while in motion and while static.

FIG. 11 conceptually illustrates a 3-dimensional image of a producing area lease or field, including the surface location, depth, deviation, as to both inclination and azimuth, rod condition and tubing condition. FIG. 4 shows a conceptual representation of a single wellbore image that has been "zoomed" into in order to analyze the specific deviation profile, rod profile and tubing profile at a specific depth. Other wellbores in the area with similar conditions may be correlated by color isograms mapping.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations, and modifications, including but not limited to those design alternatives specifically discussed herein, may be made in the practice of the invention without departing from its scope.

The invention claimed is:

1. A wellbore evaluation system for evaluating the condition of components of a well system, the well system including a production tubing string positionable in a well and a sucker rod string movable within the production tubing string, the system comprising:

a deviation sensor package movable within the production tubing string while in the well to measure deviation and inclination of the wellbore as a function of depth to generate a deviation profile;

a rod sensor package for sensing wear or corrosion of the sucker rod string as it is removed from the well to generate a rod string profile as a function of depth; and a computer in communication with the deviation sensor package and the rod sensor package for comparing the deviation profile and the rod string profile as a function of depth in the well.

2. A system as defined in claim 1, wherein the computer displays the deviation profile in substantially real time, and also displays the rod string profile in substantially real time.

3. A system as defined in claim 1, wherein the computer displays the rod string profile and the deviation profile in three dimensions.

4. A system as defined in claim 1, wherein the computer transmits the deviation profile and the rod string profile to another internet compatible computer.

5. A system as defined in claim 1, further comprising:

one or more standoff sensors to measure a standoff between a rod sensor package and one of an inner surface of the production tubing string and an outer surface of the rod string.

6. A system as defined in claim 1, further comprising:

a bar code marking device for marking segments of the production tubing string or the rod string when pulled from the well;

a bar code reader for reading the bar code markings on segments of the production tubing string when inserted into the well; and a computer for tracking segments of the production tubing string and the rod string.

7. A system as defined in claim 6, wherein the readings are RFID tags attached to the production tubing string and/or the sucker rod string.

8. A system as defined in claim 1, wherein the deviation sensor package comprises:

three pairs of gyroscopes, each pair being positioned orthogonally to each other; and three pairs of accelerometer to measure deviation from vertical.

9. A system as defined in claim 8, wherein each of the gyroscopes and the accelerometer are a single chip MEMS device.

10. A system as defined in claim 1, wherein the rod sensor comprises:

one or more of a magnetic flux sensor coil, a Hall effect device, an LVDT, and a laser micrometer.

11. A system as defined in claim 1, further comprising:

a tubing sensor package for measuring wear to the tubing string as it is pulled from the well to generate a tubing string profile.

12. A system as defined in claim 11, wherein the computer simultaneously displays the deviation profile, the rod string profile, and the tubing string profile.

13. A method for evaluating wear to components of a well system, the well system including a production tubing string positionable in a well and a sucker rod string movable within the production tubing string, the method comprising:

moving a deviation sensor package within the production tubing string while in the well to generate a deviation and inclination profile as a function of depth;

sensing rod wear to the sucker rod string as a function of depth as it is removed from the well to determine a rod string profile; and comparing of the deviation profile and rod string profile as a function of depth in the well.

14. A method as defined in claim 13, wherein a computer displays the deviation profile in substantially real time and the rod string profile in substantially real time.

15. A method as defined in claim 13, wherein a computer displays the rod profile and the deviation profile in three dimensions.

16. A method as defined in claim 13, wherein a computer transmits the deviation profile and the rod string profile to another internet compatible computer.

17. A method as defined in claim 13, further comprising:

one or more standoff sensors at the well site to measure a standoff between a rod sensor and one of an inner surface of the production tubing string and an outer surface of the rod string.

18. A method as defined in claim 13, further comprising:

marking segments of the production tubing string or the rod string when pulled from the well with a bar code marking device;

reading the bar code markings when a respective string is inserted into the well; and tracking segments of the production tubing string or the rod string based on the bar code readings.

19. A method as defined in claim 18, wherein the bar code markings are RFID tags attached to the production tubing string and/or the sucker rod string.

20. A method as defined in claim 13, wherein the rod sensor package comprises:

one or more of a magnetic flux sensor coil, a Hall effect device, an LVDT, and a laser micrometer.

21. A method as defined in claim 13, wherein the computer displays a three dimensional downhole profile from multiple wells.

22. A method as defined in claim 13, further comprising:

sensing wear to the production tubing string as it is removed from the well to determine a tubing wear profile.

23. A system for measuring the deviation of a well bore in these axes, comprising:

three pairs of orthogonally positioned MEMS Coriolis-effect gyroscopes positioned on a tool to determine a direction;

three pairs of MEMS accelerometers positioned on the tool to determine indication from vertical;

inserting the tool in the production tubing string; and a computer in communication with the gyroscopes and the accelerometer for computing the well deviation to estimate side loads and predict tubing string wear caused by engagement of a sucker rod string with the production tubing string.

24. A method as defined in claim 23, wherein the tool passes through the tubing string in the well while the gyroscopes and accelerometers take measurements.

25. A method as defined in claim 23, wherein a GPS device is used to initially orient the tool.

26. A wellbore evaluation system for evaluating the condition of components of a well system, the well system including at least one of a production tubing string positioned in a well and a sucker rod string movable within the production tubing string, the system comprising: a string sensor package comprising 24 or more circumferentially oriented sensors for sensing wear or corrosion of at least one of the tubing string and the rod string as it is removed from the well to generate a string profile as a function of depth; and a computer in communication with the string sensor package for generating the string profile as a function of depth in the well and circumferential position of a sensor.

27. A system as defined in claim 26, wherein the computer displays the string profile in substantially real time.

28. A system as defined in claim 27, wherein the string sensor package includes one or more of a magnetic flux coil sensor, a Hall effect sensor, an LVDT sensor, a laser micrometer sensor, and a laser triangulation sensor; and the computer processes multiple signals from a plurality of said sensors as a function of both depth of the string in the well and circumferential position of a sensor about the string; and the computer displays, in substantially real time as the string is pulled from the well, a representation of the cross-section of the string and a representation of an outer diameter of the string, and a representation of wall thickness of the string, based on axial depth of the string being tested and a circumferential position of specific sensors, such that individual lengths of a string may be classified as to fitness for purpose.

29. A system as defined in claim 26, further comprising:

one or more standoff sensors at the well site to measure a standoff between a sensor in string sensor package and an outer surface of the string.

30. A system as defined in claim 26, wherein the string sensor package comprises:

one or more of a magnetic flux sensor coil, a Hall effect device, an LVDT, a laser micrometer and a laser triangulation sensor.

31. A wellbore evaluation system for evaluating the condition of components of a well system, the well system including a production tubing string positionable in a well and a sucker rod string movable within the production tubing string, the system comprising:

a deviation sensor package movable within the production tubing string while in the well to measure deviation and inclination of the wellbore as a function of depth to generate a deviation profile as a function of depth;

a rod sensor package for sensing defects in the sucker rod string as it is removed from the well to generate a rod string profile as a function of depth;

one or more standoff sensors to measure a standoff between a rod sensor package and one of an inner surface of the production tubing string and an outer surface of the rod string; and a computer in communication with the deviation sensor package and the rod sensor package for comparing the deviation profile and the rod string profile as a function of depth in the well.

32. A system as defined in claim 31, wherein the computer displays the deviation profile and the rod string profile in substantially real time.

33. A system as defined in claim 31, wherein the computer displays the rod string profile and the deviation profile in three dimensions.

34. A system as defined in claim 31, wherein the deviation sensor package comprises:

three pairs of gyroscopes, each pair being positioned orthogonally to each other; and three pairs of accelerometer to measure deviation from vertical.

35. A system as defined in claim 31, further comprising:

a tubing sensor package for measuring wear to the tubing string as it is pulled from the well to generate a tubing string profile.

36. A system as defined in claim 35, wherein the computer simultaneously displays the deviation profile, the rod string profile, and the tubing string profile.

37. A method for evaluating wear to components of a well system, the well system including a production tubing string positionable in a well and a sucker rod string movable within the production tubing string, the method comprising:

moving a deviation sensor package within the production tubing string while in the well to generate a deviation and inclination profile as a function of depth;

sensing rod wear to the sucker rod string as a function of depth as it is removed from the well to determine a rod string profile;

marking segments of the production tubing string or the rod string with RFID tags when pulled from the well with a bar code marking device;

reading the bar code markings when a respective string is inserted into the well;

tracking segments of the production tubing string or the rod string based on the bar code readings; and comparing of the deviation profile and rod string profile as a function of depth in the well.

38. A method as defined in claim 37, wherein a computer displays the deviation profile in substantially real time and the rod string profile in substantially real time.

39. A method as defined in claim 38, wherein a computer displays the rod profile and the deviation profile in three dimensions.

40. A method as defined in claim 37, further comprising:

measuring a standoff between a rod sensor and one of an inner surface of the production tubing string and an outer surface of the rod string.

41. A method as defined in claim 37, further comprising:

sensing wear to the production tubing string as it is removed from the well to determine a tubing wear profile.

* * * * *